US011638458B2

(12) United States Patent
Durocher

(10) Patent No.: US 11,638,458 B2
(45) **Date of Patent: *May 2, 2023**

(54) HELMET FOR IMPACT PROTECTION

(71) Applicant: BAUER HOCKEY LLC, Exeter, NH (US)

(72) Inventor: Jacques Durocher, St-Jerome (CA)

(73) Assignee: BAUER HOCKEY LLC, Exeter, NH (US)

( * ) Notice: Subject to any disclaimer, the term of this patent is extended or adjusted under 35 U.S.C. 154(b) by 39 days.

This patent is subject to a terminal disclaimer.

(21) Appl. No.: 17/371,277

(22) Filed: Jul. 9, 2021

(65) Prior Publication Data

US 2021/0401103 A1 Dec. 30, 2021

Related U.S. Application Data

(63) Continuation of application No. 15/960,915, filed on Apr. 24, 2018, now Pat. No. 11,089,833, which is a continuation of application No. 14/828,051, filed on Aug. 17, 2015, now Pat. No. 9,961,952.

(51) Int. Cl.
*A42B 3/12* (2006.01)

(52) U.S. Cl.
CPC ..... *A42B 3/127* (2013.01)

(58) Field of Classification Search
CPC ..... A42B 3/127; A42B 3/00; A42B 3/14
See application file for complete search history.

(56) References Cited

U.S. PATENT DOCUMENTS

| | | | |
|---|---|---|---|
| 3,350,718 | A | 11/1967 | Webb |
| 3,413,656 | A | 12/1968 | Vogliano et al. |
| 3,447,162 | A | 6/1969 | Aileo |
| 3,471,866 | A | 10/1969 | Raney |
| 3,609,764 | A | 10/1971 | Morgan |
| 3,866,243 | A | 2/1975 | Morgan |
| 3,897,597 | A | 8/1975 | Kasper |
| 4,012,794 | A | 3/1977 | Nomiyama |
| 4,023,213 | A | 5/1977 | Rovani |
| 4,024,586 | A | 5/1977 | Lamb |
| 4,055,860 | A | 11/1977 | King |
| 4,185,331 | A | 1/1980 | Nomiyama |

(Continued)

FOREIGN PATENT DOCUMENTS

| | | |
|---|---|---|
| CA | 1154552 | 10/1983 |
| CA | 1183302 | 3/1985 |

(Continued)

OTHER PUBLICATIONS

Examiner Report dated Oct. 25, 2021 in connection with Canadian Patent Application No. 2901035, 5 pages.

(Continued)

*Primary Examiner* — Tajash D Patel

(57) ABSTRACT

A helmet for protecting a head of a wearer, such as a hockey, lacrosse, football or other sports player. The helmet may have various features to protect the wearer's head against impacts, such as linear impacts and rotational impacts. For example, pads of the helmet may be movable relative to one another in response to an impact on the helmet. The helmet may comprise a frame comprising a plurality of frame members carrying respective ones of the pads and configured to move relative to one another in response to the impact to allow relative movement of the pads.

26 Claims, 25 Drawing Sheets

(56) References Cited

U.S. PATENT DOCUMENTS 4,287,613 A 9/1981 Schulz
4,307,471 A 12/1981 Lovell
4,477,929 A 10/1984 Mattson
4,685,315 A 8/1987 Comolli
4,932,076 A 6/1990 Giorgio et al.
4,942,628 A 7/1990 Freund
5,068,922 A 12/1991 Zahn
5,204,998 A 4/1993 Liu
5,249,347 A 10/1993 Marinitz
5,315,718 A 5/1994 Barson et al.
5,412,814 A 5/1995 Pernicka et al.
5,483,699 A 1/1996 Pemicka et al.
5,511,250 A 4/1996 Field et al.
5,571,217 A 11/1996 Del Bon et al.
5,638,551 A 6/1997 Lallemand
D400,311 S 10/1998 Chartrand
5,832,569 A 11/1998 Berg
5,845,341 A 12/1998 Barthold et al.
5,867,840 A 2/1999 Hirosawa et al.
5,950,244 A 9/1999 Fournier et al.
5,950,245 A 9/1999 Binduga
5,953,761 A 9/1999 Jurga et al.
5,956,776 A 9/1999 Chartrand
6,032,297 A 3/2000 Barthold et al.
6,081,931 A 7/2000 Burns et al.
6,101,636 A 8/2000 Williams
6,108,824 A 8/2000 Fournier et al.
6,125,477 A 10/2000 Croppa et al.
6,240,571 B1 6/2001 Infusino
6,256,798 B1 7/2001 Egolf et al.
6,272,692 B1 8/2001 Abraham
6,298,497 B1 10/2001 Chartrand
6,324,700 B1 12/2001 McDougall
6,338,165 B1 1/2002 Biondich
6,385,780 B1 5/2002 Racine
6,389,607 B1 5/2002 Wood
6,401,261 B1 6/2002 Arney et al.
6,453,476 B1 9/2002 Moore, III
6,560,787 B2 5/2003 Mendoza
6,592,536 B1 7/2003 Argenta
6,658,671 B1 12/2003 Von Holst et al.
6,681,409 B2 1/2004 Dennis et al.
6,751,808 B2 6/2004 Puchalski
6,772,447 B2 8/2004 Morrow et al.
6,817,039 B1 11/2004 Grilliot et al.
6,862,747 B2 3/2005 Oleson
6,865,752 B2 3/2005 Udelhofen et al.
6,883,183 B2 4/2005 Morrow et al.
6,886,183 B2 5/2005 DeHaan et al.
6,920,644 B1 7/2005 Higgs
6,934,971 B2 8/2005 Ide et al.
6,952,839 B2 10/2005 Long
6,961,963 B2 11/2005 Rosie
6,964,066 B2 11/2005 Tucker
6,966,075 B2 11/2005 Racine
6,968,575 B2 11/2005 Durocher
6,981,284 B2 1/2006 Durocher
6,996,856 B2 2/2006 Puchalski
7,043,772 B2 6/2006 Bielefeld et al.
7,076,811 B2 7/2006 Puchalski
7,174,575 B1 2/2007 Scherer
7,222,374 B2 5/2007 Musal et al.
7,341,776 B1 3/2008 Milliren et al.
7,603,725 B2 10/2009 Harris
7,634,820 B2 12/2009 Rogers et al.
7,673,351 B2 3/2010 Copeland
7,677,538 B2 3/2010 Darnell et al.
7,870,618 B2 1/2011 Pilon et al.
7,908,678 B2 3/2011 Brine, III et al.
7,930,771 B2 4/2011 Depreitere et al.
7,950,073 B2 5/2011 Ferrara
7,954,178 B2 6/2011 Durocher et al.
8,037,548 B2 10/2011 Alexander et al.
8,039,078 B2 10/2011 Moore et al.
8,095,995 B2 1/2012 Alexander et al.
8,156,574 B2 4/2012 Stokes et al.
8,296,867 B2 10/2012 Rudd et al.
8,296,868 B2 10/2012 Belanger et al.
8,316,512 B2 11/2012 Halldin
8,448,266 B2 5/2013 Alexander et al.
8,544,118 B2 10/2013 Brine, III et al.
8,566,968 B2 10/2013 Marzec et al.
8,566,969 B2 10/2013 Glogowski et al.
8,578,520 B2 11/2013 Halldin
8,713,716 B2 5/2014 Krueger
8,832,870 B2 9/2014 Belanger et al.
8,850,622 B2 10/2014 Finiel et al.
8,887,318 B2 11/2014 Mazzarolo et al.
9,095,179 B2 8/2015 Kwan et al.
9,345,282 B2 5/2016 Durocher et al.
9,743,702 B2 8/2017 Warmouth
9,961,952 B2 5/2018 Durocher
10,292,449 B2 5/2019 Durocher et al.
10,306,941 B2 6/2019 Durocher et al.
10,334,904 B2 7/2019 Durocher et al.
10,477,909 B2 11/2019 Laperriere et al.
11,089,833 B2 8/2021 Durocher
2001/0032351 A1 10/2001 Nakayama et al.
2002/0035748 A1 3/2002 Racine
2003/0070201 A1 4/2003 McClelland
2003/0106138 A1 6/2003 Guay
2003/0135914 A1 7/2003 Racine et al.
2003/0221245 A1 12/2003 Lee et al.
2004/0025231 A1 2/2004 Ide et al.
2004/0040073 A1 3/2004 Morrow et al.
2004/0117896 A1 6/2004 Madey et al.
2004/0117897 A1 6/2004 Udelhofen et al.
2004/0168246 A1 9/2004 Phillips
2004/0172739 A1 9/2004 Racine
2004/0199981 A1 10/2004 Tucker
2004/0250340 A1 12/2004 Piper et al.
2004/0255370 A1 12/2004 Moeller et al.
2005/0015857 A1 1/2005 Desjardins et al.
2005/0034222 A1 2/2005 Durocher
2005/0034223 A1 2/2005 Durocher
2005/0125882 A1 6/2005 Long
2005/0262619 A1 12/2005 Musal et al.
2006/0059606 A1 3/2006 Ferrara
2006/0096011 A1 5/2006 Dennis et al.
2006/0191403 A1 8/2006 Hawkind et al.
2006/0206994 A1 9/2006 Rogers et al.
2007/0044193 A1 3/2007 Durocher et al.
2007/0079429 A1 4/2007 Pilon et al.
2007/0083965 A1 4/2007 Darnell et al.
2007/0157370 A1 7/2007 Joubert Des Ouches
2007/0169251 A1 7/2007 Rogers et al.
2007/0190292 A1 8/2007 Ferrara
2007/0199136 A1 8/2007 Brine et al.
2007/0245466 A1 10/2007 Lilenthal et al.
2007/0266481 A1 11/2007 Garnet et al.
2008/0066217 A1 3/2008 Depreitere et al.
2008/0155735 A1 7/2008 Ferrara
2008/0276354 A1 11/2008 Stokes et al.
2008/0289085 A1 11/2008 Bryant et al.
2009/0031482 A1 2/2009 Stokes et al.
2009/0038055 A1 2/2009 Ferrara
2009/0044315 A1 2/2009 Belanger et al.
2009/0158506 A1 6/2009 Thompson et al.
2009/0188022 A1 6/2009 Durocher et al.
2009/0178184 A1 7/2009 Brine, III et al.
2009/0222978 A1 9/2009 Fang
2010/0005573 A1 1/2010 Rudd et al.
2010/0043126 A1 2/2010 Morel
2010/0050323 A1 3/2010 Durocher et al.
2010/0107317 A1 5/2010 Wang
2010/0115686 A1 5/2010 Halldin
2010/0132099 A1 6/2010 Green et al.
2010/0151631 A1 6/2010 Pu et al.
2010/0180363 A1 7/2010 Glogowski et al.
2010/0186150 A1 7/2010 Ferrara et al.
2011/0004980 A1 1/2011 Leatt et al.
2011/0047679 A1 3/2011 Rogers et al.
2011/0083251 A1 4/2011 Mandell
2011/0117310 A1 5/2011 Anderson et al.

(56) References Cited

U.S. PATENT DOCUMENTS

| | | | |
|---|---|---|---|
| 2011/0171420 | A1 | 7/2011 | Yang |
| 2012/0060251 | A1 | 3/2012 | Schimpf |
| 2012/0096631 | A1 | 4/2012 | King et al. |
| 2012/0110720 | A1 | 5/2012 | Mazzarolo et al. |
| 2012/0198604 | A1 | 8/2012 | Weber et al. |
| 2012/0204329 | A1 | 8/2012 | Faden et al. |
| 2012/0208032 | A1 | 8/2012 | Faden et al. |
| 2013/0000018 | A1 | 1/2013 | Rudd et al. |
| 2013/0025032 | A1 | 1/2013 | Durocher et al. |
| 2013/0040524 | A1 | 2/2013 | Halldin et al. |
| 2013/0061371 | A1 | 3/2013 | Phipps et al. |
| 2013/0122256 | A1 | 5/2013 | Kleiven et al. |
| 2013/0185837 | A1 | 7/2013 | Phipps et al. |
| 2013/0247284 | A1 | 9/2013 | Hoshizaki et al. |
| 2014/0013492 | A1 | 1/2014 | Bottlang et al. |
| 2014/0109300 | A1 | 4/2014 | Durocher et al. |
| 2014/0189945 | A1 | 7/2014 | Golnaraghi et al. |
| 2015/0089722 | A1 | 4/2015 | Berry |
| 2015/0089724 | A1 | 4/2015 | Berry |
| 2015/0113718 | A1 | 4/2015 | Bayer |
| 2015/0216248 | A1 | 8/2015 | Blair |
| 2016/0235151 | A1 | 8/2016 | Durocher et al. |
| 2019/0116911 | A1 | 4/2019 | Durocher et al. |
| 2019/0350297 | A1 | 11/2019 | Durocher et al. |
| 2020/0187582 | A1 | 6/2020 | Laperriere et al. |

FOREIGN PATENT DOCUMENTS

| | | |
|---|---|---|
| CA | 1217601 | 2/1987 |
| CA | 1290324 | 10/1991 |
| CA | 2048028 | 12/1994 |
| CA | 2230616 | 3/1997 |
| CA | 2191683 | 3/2005 |
| CA | 2290324 | 5/2005 |
| CA | 2321399 | 7/2005 |
| CA | 2191693 | 11/2005 |
| CA | 2598015 | 8/2006 |
| CA | 2273621 | 2/2008 |
| CA | 2357690 | 1/2009 |
| CA | 2638703 | 2/2009 |
| CA | 2916360 | 2/2009 |
| CA | 2437626 | 4/2009 |
| CA | 2533493 | 5/2009 |
| CA | 2561540 | 8/2010 |
| CA | 2573640 | 9/2010 |
| CA | 2759915 | 2/2012 |
| CA | 2573639 | 5/2012 |
| CA | 2872140 | 10/2012 |
| CA | 2880069 | 10/2012 |
| CA | 3133927 | 10/2012 |
| CA | 2917968 | 1/2013 |
| CA | 2659638 | 7/2013 |
| CA | 2784316 | 10/2013 |
| CA | 2804937 | 11/2013 |
| CA | 2878613 | 1/2014 |
| CA | 2821540 | 1/2015 |
| CA | 2847669 | 2/2015 |
| CA | 2838103 | 3/2015 |
| CA | 2798542 | 7/2015 |
| CA | 2783079 | 3/2016 |
| CA | 2966656 | 5/2016 |
| CA | 2963353 | 2/2018 |
| CA | 3018280 | 11/2021 |
| DE | 10037461 | 2/2002 |
| EP | 1142495 | 10/2001 |
| EP | 1494990 | 1/2005 |
| EP | 1635664 | 3/2006 |
| EP | 1429635 | 7/2007 |
| EP | 2550885 | 1/2013 |
| EP | 2550886 | 1/2013 |
| EP | 2742817 | 6/2014 |
| GB | 191419109 | 2/1915 |
| JP | H03122726 | 5/1991 |
| JP | 2005146468 | 6/2005 |
| SE | 518223 | 9/2002 |
| SE | 1050458 | 1/2012 |
| WO | 19960014768 | 5/1996 |
| WO | 0145526 | 6/2001 |
| WO | 2001045526 | 6/2001 |
| WO | 2004000054 | 12/2003 |
| WO | 2006005143 | 1/2006 |
| WO | 2006005183 | 1/2006 |
| WO | 2006099928 | 9/2006 |
| WO | 2007025500 | 3/2007 |
| WO | 2008085108 | 7/2008 |
| WO | 2008103107 | 8/2008 |
| WO | 2010082919 | 7/2010 |
| WO | 2010122586 | 10/2010 |
| WO | 2010151631 | 12/2010 |
| WO | 2011139224 | 11/2011 |
| WO | 2011141562 | 11/2011 |
| WO | 2015166598 | 11/2015 |

OTHER PUBLICATIONS

Examiner Report dated Oct. 26, 2021 in connection with Canadian Patent Application No. 2934368, 3 pages.

Non-Final Office Action dated Jan. 20, 2022 in connection with U.S. Appl. No. 16/594,488, 54 pages.

Notice of Allowance dated Apr. 26, 2022 in connection to U.S. Appl. No. 16/594,488, 18 pages.

Restriction Requirement dated Mar. 10, 2022 in connection with U.S. Appl. No. 16/396,837, 7 pages.

European Search Report dated Aug. 19, 2014 in connection with European Patent Application No. 14155104.4, 6 pages.

European Search Report dated Oct. 31, 2012 in connection with European Patent Application No. 1217838.7, 5 pages.

Examiner's Report dated Dec. 21, 2016 in connection with Canadian Patent Application No. 2,880,069, 4 pages.

Examiner's Report dated Feb. 4, 2015 in connection with Canadian Patent Application No. 2872140, 4 pages.

Examiner's Report dated Jul. 16, 2014 in connection with Canadian Patent Application No. 2821540, 2 pages.

Examiner's Report dated May 23, 2014 in connection with Canadian Patent Application No. 2821540, 2 pages.

Examiner's Report dated May 23, 2014 in connection with Canadian Patent Application No. 2838103, 4 pages.

Examiner's Report dated May 28, 2014 in connection with Canadian Patent Application No. 2847669, 4 pages.

Examiner's Report dated Sep. 16, 2014 in connection with Canadian Patent Application No. 2838103, 3 pages.

Examiner's Report dated Sep. 9, 2016 in connection with Canadian Patent Application No. 2,880,069, 5 pages.

Final Office Action dated Jan. 28, 2021 in connection with U.S. Appl. No. 15/960,915. 61 pages.

Final Office Action dated Aug. 24, 2016 in connection with U.S. Appl. No. 13/560,546, 10 pages.

Final Office Action dated Jul. 13, 2017 in connection with U.S. Appl. No. 14/139,049, 5 pages.

International Search Report dated Mar. 16, 2015 in connection with International Application No. PCT/CA2014/000911, 8 pages.

Non-Final Office Action dated Aug. 17, 2015 in connection with U.S. Appl. No. 13/560,546, 37 pages.

Non-Final Office Action dated May 4, 2017 in connection with U.S. Appl. No. 14/828,051, 8 pages.

Non-Final Office Action dated Oct. 6, 2016 in connection with U.S. Appl. No. 14/139,049, 14 pages.

Non-Final Office Action dated Sep. 21, 2018 in connection with U.S. Appl. No. 15/106,192, 64 pages.

Final Office Action dated Apr. 25, 2019 in connection with U.S. Appl. No. 15/106,192, 53 pages.

Notice of Allowance dated Jul. 5, 2019 in connection with U.S. Appl. No. 15/106,192, 9 pages.

Notice of Allowance dated Apr. 9, 2018 in connection with U.S. Appl. No. 14/139,049, 7 pages.

Notice of Allowance dated Dec. 28, 2017 in connection with U.S. Appl. No. 14/828,051, 5 pages.

(56) References Cited

OTHER PUBLICATIONS

Notice of Allowance dated Jan. 18, 2018 in connection with U.S. Appl. No. 14/828,051, 4 pages.
Notice of Allowance dated Jan. 30, 2019 in connection with U.S. Appl. No. 14/139,049, 10 pages.
Notice of Allowance dated Mar. 13, 2019 in connection with U.S. Appl. No. 13/560,546, 10 pages.
Notice of Allowance dated May 10, 2017 in connection with U.S. Appl. No. 13/560,546, 7 pages.
Notice of Allowance dated May 18, 2018 in connection with U.S. Appl. No. 13/560,546, 7 pages.
Notice of Allowance dated Oct. 30, 2017 in connection with U.S. Appl. No. 13/560,546, 7 pages.
Notice of Allowance dated Oct. 4, 2018 in connection with U.S. Appl. No. 14/139,049, 7 pages.
Notice of Allowance dated Sep. 25, 2018 in connection with U.S. Appl. No. 13/560,546, 7 pages.
Office Action dated Apr. 22, 2016 in connection with European Patent Application No. 14155104.4, 2 pages.
Office Action dated Feb. 24, 2015 in connection with European Patent Application No. 14155104.4, 2 pages.
Office Action dated Jun. 27, 2013 in connection with European Patent Application No. 1217838.7, 2 pages.
Summons to attend oral proceedings issued by the European Patent Office opposition division in connection to the Application No. 12178380.7—Patent No. 1731/2550886 on Jul. 6, 2017, 33 pages.
Supplemental Notice of Allowability dated Jun. 14, 2017 in connection with U.S. Appl. No. 13/560,546, 2 pages.
Written Opinion dated Mar. 16, 2015 in connection with International Application No. PCT/CA2014/000911, 9 pages.
Examiner's Report dated Apr. 21, 2020 in connection with CA Patent Application No. 3,018,280, 4 pages.
Examiner's Report dated Oct. 1, 2020 in connection with CA Patent Application No. 3,018,280, 4 pages.
Restriction Requirement dated Oct. 2, 2020 in connection with U.S. Appl. No. 15/960,915, 6 pages.
Examiner's Report dated Feb. 22, 2021 in connection with Canadian Patent Application No. 2,934,368, 5 pages.
Notice of Allowance dated Apr. 12, 2021 in connection to U.S. Appl. No. 15/960,915, 7 pages.
Notice of Allowance dated Jun. 8, 2021 in connection with Canadian Patent Application No. 3,018,280, 1 page.
Non-Final Office Action dated Jul. 5, 2022 in connection with U.S. Appl. No. 16/396,837, 54 pages.

HELMET FOR IMPACT PROTECTION

CROSS-REFERENCE TO RELATED APPLICATIONS

This application is a continuation of U.S. patent application Ser. No. 15/960,915 filed on Apr. 24, 2018 and issued as U.S. Pat. No. 11,089,833, which is a continuation of U.S. patent application Ser. No. 14/828,051 filed on Aug. 17, 2015 and issued as U.S. Pat. No. 9,961,952, all of which are incorporated by reference herein.

FIELD

The invention relates generally to helmets and, more particularly, to helmets providing protection against impacts (e.g., while engaged in sports or other activities).

BACKGROUND

Helmets are worn in sports (e.g., hockey, lacrosse, football, etc.) and other activities (e.g., motorcycling, industrial work, military activities, etc.) to protect their wearers against head injuries. To that end, helmets typically comprise a rigid outer shell and inner padding to absorb energy when impacted.

Various types of impacts are possible. For example, a helmet may be subjected to a linear impact in which an impact force is generally oriented to pass through a center of gravity of the wearer's head and imparts a linear acceleration to the wearer's head. A helmet may also be subjected to a rotational impact in which an impact force imparts an angular acceleration to the wearer's head. This can cause serious injuries such as concussions, subdural hemorrhage, or nerve damage. Also, a helmet may experience high-energy impacts (e.g., greater than 40 Joules) and/or low-energy impacts (e.g., 40 Joules or less) that can cause different kinds of harm or injury.

Although helmets typically provide decent protection against linear impacts, their protection against rotational impacts is often deficient. This is clearly problematic given the severity of head injuries caused by rotational impacts.

Also, while various forms of protection against linear impacts have been developed, existing techniques may not always be adequate or optimal in some cases, such as for certain types of impacts (e.g., high- and low-energy impacts).

For these and other reasons, there is a need for improvements directed to providing helmets with enhanced impact protection.

SUMMARY OF THE INVENTION

According to various aspects of the invention, there is provided a helmet for protecting a head of a wearer. The helmet may have various features to protect the wearer's head against impacts, such as linear impacts and rotational impacts. For instance, pads of the helmet may be movable relative to one another in response to an impact on the helmet. The helmet may comprise a frame comprising a plurality of frame members carrying respective ones of the pads and configured to move relative to one another in response to the impact to allow relative movement of the pads.

For example, according to an aspect of the invention, there is provided a helmet for protecting a head of a wearer. The helmet comprises an outer shell and inner padding disposed within the outer shell. The inner padding comprises a plurality of pads configured to move relative to one another in response to an impact on the helmet.

According to another aspect of the invention, there is provided a helmet for protecting a head of a wearer. The helmet comprises an outer shell and inner padding disposed within the outer shell. The inner padding comprises a plurality of pads and a frame carrying the pads and configured to allow the pads to move relative to one another in response to an impact on the helmet.

According to another aspect of the invention, there is provided a helmet for protecting a head of a wearer. The helmet comprises an outer shell and inner padding disposed within the outer shell. The inner padding comprises a plurality of pads and a frame carrying the pads. The frame comprises a plurality of frame members carrying respective ones of the pads and configured to move relative to one another in response to an impact on the helmet.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

FIGS. 1 to 10 show an example of a helmet 10 for protecting a head 11 of a wearer in accordance with an embodiment of the invention. In this embodiment, the helmet 10 is a sports helmet for protecting the head 11 of the wearer who is a sports player. More particularly, in this embodiment, the helmet 10 is a hockey helmet for protecting the head 11 of the wearer who is a hockey player. In other embodiments, the helmet 10 may be any other type of helmet for other sports (e.g., lacrosse, football, baseball, bicycling, skiing, snowboarding, horseback riding, etc.) and activities other than sports (e.g., motorcycling, industrial applications, military applications, etc.) in which protection against head injury is desired.

The helmet 10 defines a cavity 13 for receiving the wearer's head 11 to protect the wearer's head 11 when the helmet 10 is impacted (e.g., when the helmet 10 hits a board or an ice or other skating surface of a hockey rink or is struck by a puck or a hockey stick). In this embodiment, the helmet 10 is designed to provide protection against various types of impacts. More particularly, in this embodiment, the helmet 10 is designed to provide protection against a linear impact in which an impact force is generally oriented to pass through a center of gravity of the wearer's head 11 and imparts a linear acceleration to the wearer's head 11. In addition, in this embodiment, the helmet 10 is designed to provide protection against a rotational impact in which an impact force imparts an angular acceleration to the wearer's head 11. The helmet 10 is also designed to protect against high-energy impacts and low-energy impacts.

In response to an impact, the helmet 10 absorbs energy from the impact to protect the wearer's head 11. Notably, in this embodiment, as further discussed below, pads of the helmet 10 are movable relative to one another in response to an impact on the helmet 10. This can enhance protection of the wearer's head 11. For example, this may provide protection against rotational impacts, by absorbing rotational energy from the rotational impact, thereby reducing rotational energy transmitted to the wearer's head 11 and, therefore, an angular acceleration of the wearer's 11.

Figure 11:
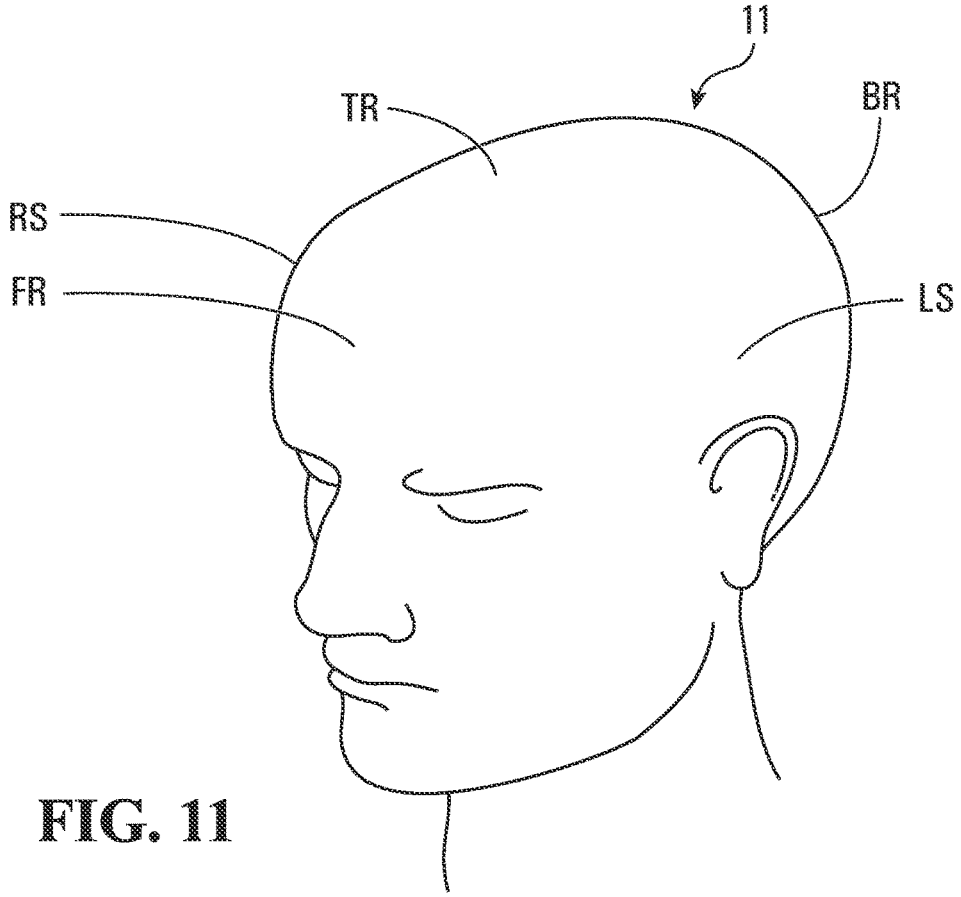
FIGS. 11 and 12 show the head of the wearer.
Figure 12:
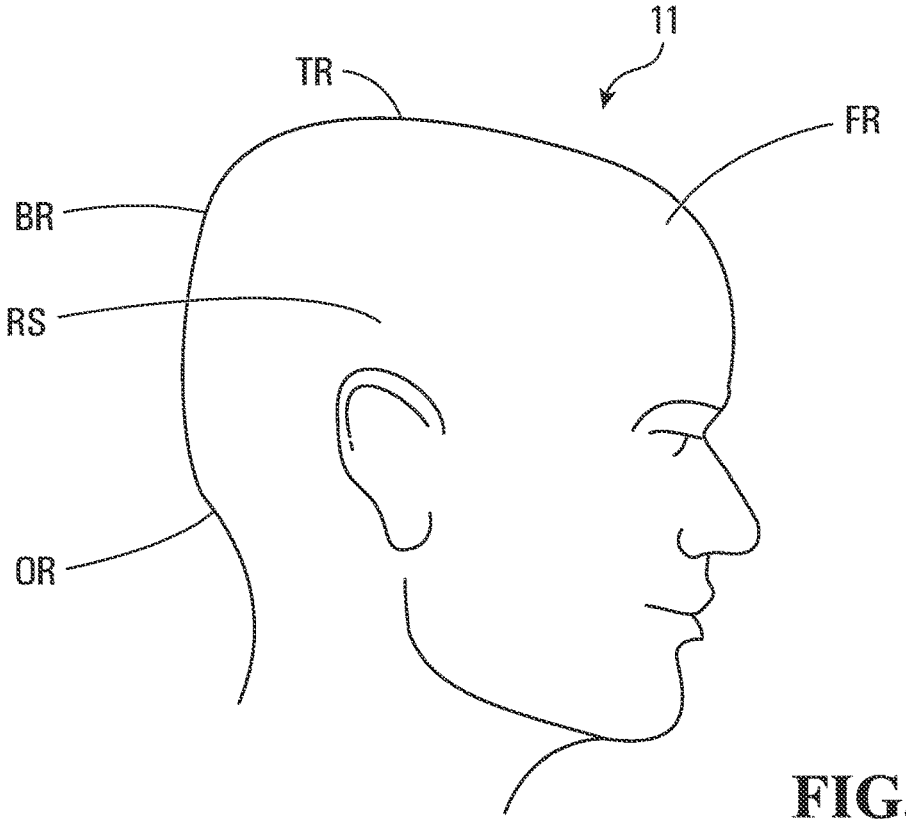

The helmet 10 protects various regions of the wearer's head 11. As shown in FIGS. 11 and 12, the wearer's head 11 comprises a front region FR, a top region TR, left and right side regions LS, RS, a back region BR, and an occipital region OR. The front region FR includes a forehead and a front top part of the head 11 and generally corresponds to a frontal bone region of the head 11. The left and right side regions LS, RS are approximately located above the wearer's ears. The back region BR is opposite the front region FR and includes a rear upper part of the head 11. The occipital region OR substantially corresponds to a region around and under the head's occipital protuberance.

The helmet 10 comprises an external surface 18 and an internal surface 20 that contacts the wearer's head 11 when the helmet 10 is worn. The helmet 10 has a front-back axis FBA, a left-right axis LRA, and a vertical axis VA which are respectively generally parallel to a dorsoventral axis, a dextrosinistral axis, and a cephalocaudal axis of the wearer when the helmet 10 is worn and which respectively define a front-back direction, a left-right direction, and a vertical direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the left-right direction can also be referred to a longitudinal direction and a transversal direction. A length L of the helmet 10 is a dimension of the helmet 10 in its longitudinal direction, a width W of the helmet 10 is a dimension of the helmet 10 in its transversal direction, and a height H of the helmet 10 is a dimension of the helmet 10 in its vertical direction.

Figure 13:
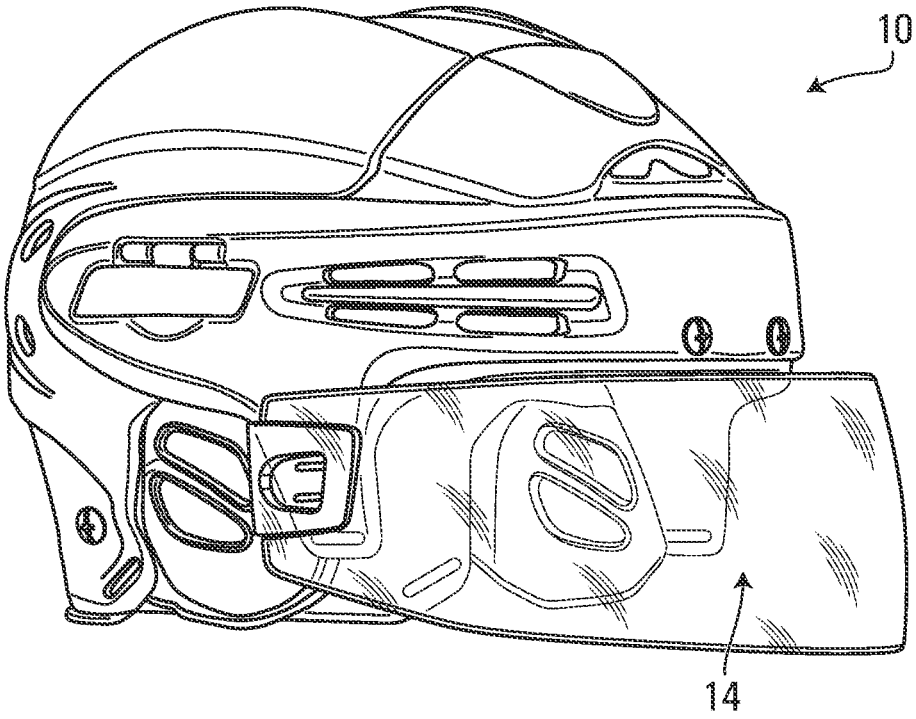
FIGS. 13 and 14 show examples of a faceguard that may be provided on the helmet.
Figure 14:
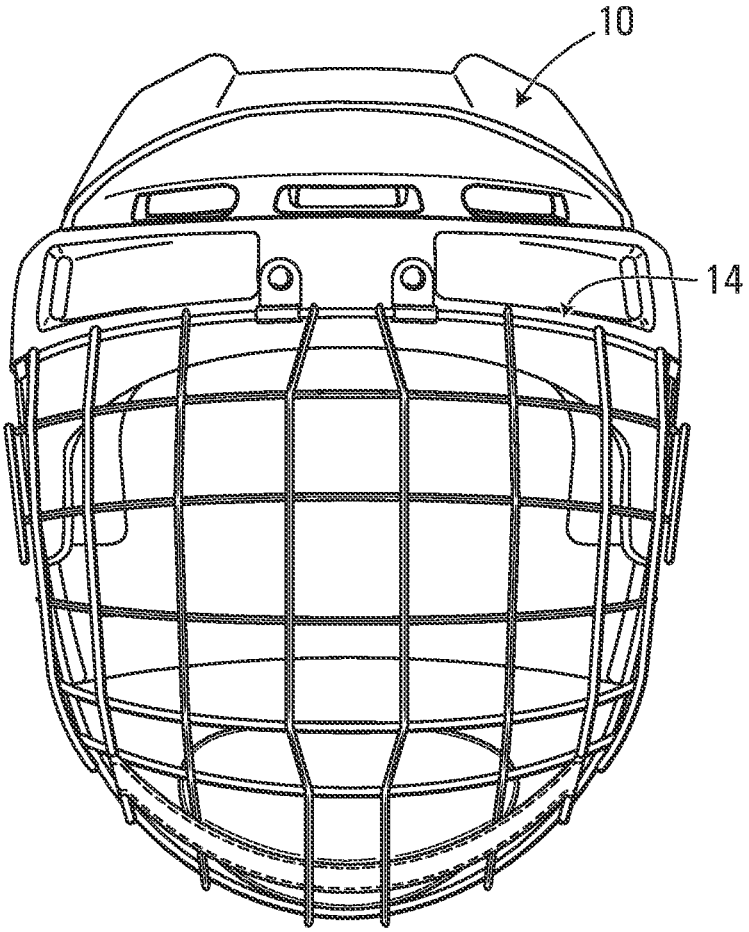

In this embodiment, the helmet 10 comprises an outer shell 12 and inner padding 15. The helmet 10 also comprises a chinstrap 16 for securing the helmet 10 to the wearer's head 11. As shown in FIGS. 13 and 14, the helmet 10 may also comprise a faceguard 14 to protect at least part of the wearer's face (e.g., a grid (sometimes referred to as a "cage") or a visor (sometimes referred to as a "shield")).

The outer shell 12 provides strength and rigidity to the hockey helmet 10. To that end, the outer shell 12 is made of rigid material. For example, in various embodiments, the outer shell 12 may be made of thermoplastic material such as polyethylene (PE), polyamide (nylon), or polycarbonate, of thermosetting resin, or of any other suitable material. The outer shell 12 has an inner surface 17 facing the inner padding 15 and an outer surface 19 opposite the inner surface 17. The outer surface 19 of the outer shell 12 constitutes at least part of the external surface 18 of the helmet 10.

In this embodiment, the outer shell 12 comprises a front outer shell member 22 and a rear outer shell member 24 that are connected to one another. The front outer shell member 22 comprises a top portion 21 for facing at least part of the top region TR of the wearer's head 11, a front portion 23 for facing at least part of the front region FR of the wearer's head 11, and left and right lateral side portions 25, 27 extending rearwardly from the front portion 23 for facing at least part of the left and right side regions LS, RS of the wearer's head 11. The rear outer shell member 24 comprises a top portion 29 for facing at least part of the top region TR of the wearer's head 11, a back portion 31 for facing at least part of the back region BR of the wearer's head 11, an occipital portion 37 for facing at least part of the occipital region OR of the wearer's head 11, and left and right lateral side portions 33, 35 extending forwardly from the back portion 31 for facing at least part of the left and right side regions LS, RS of the wearer's head 11.

Figure 15:
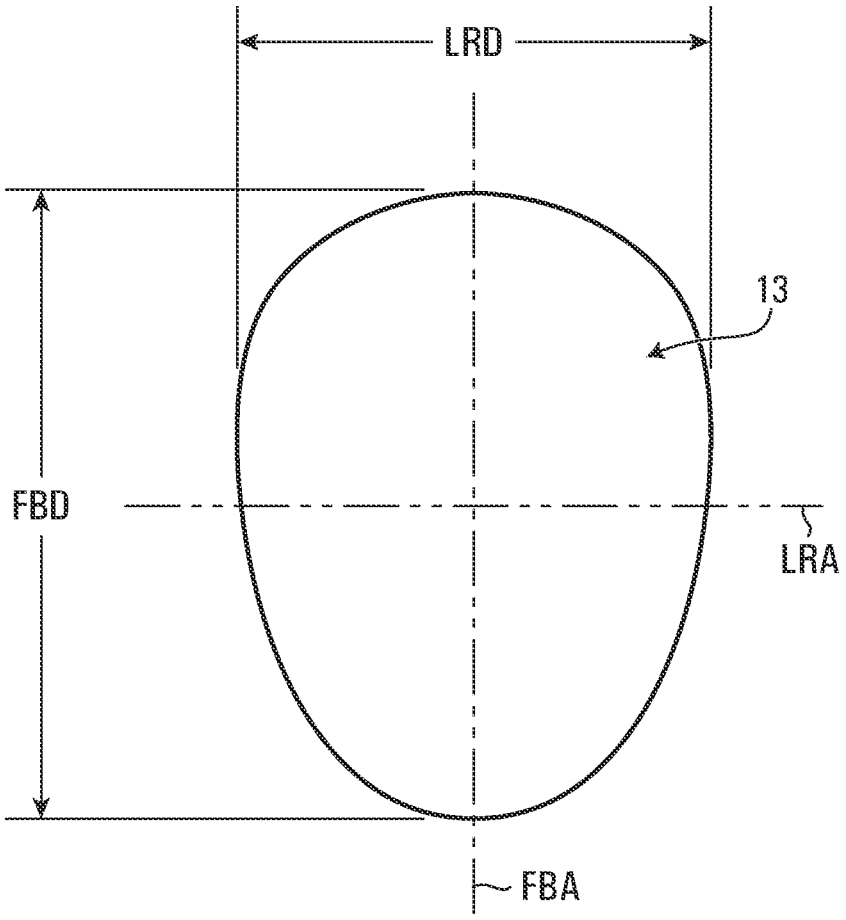
FIG. 15 shows internal dimensions of a head-receiving cavity of the helmet.
Figure 16:
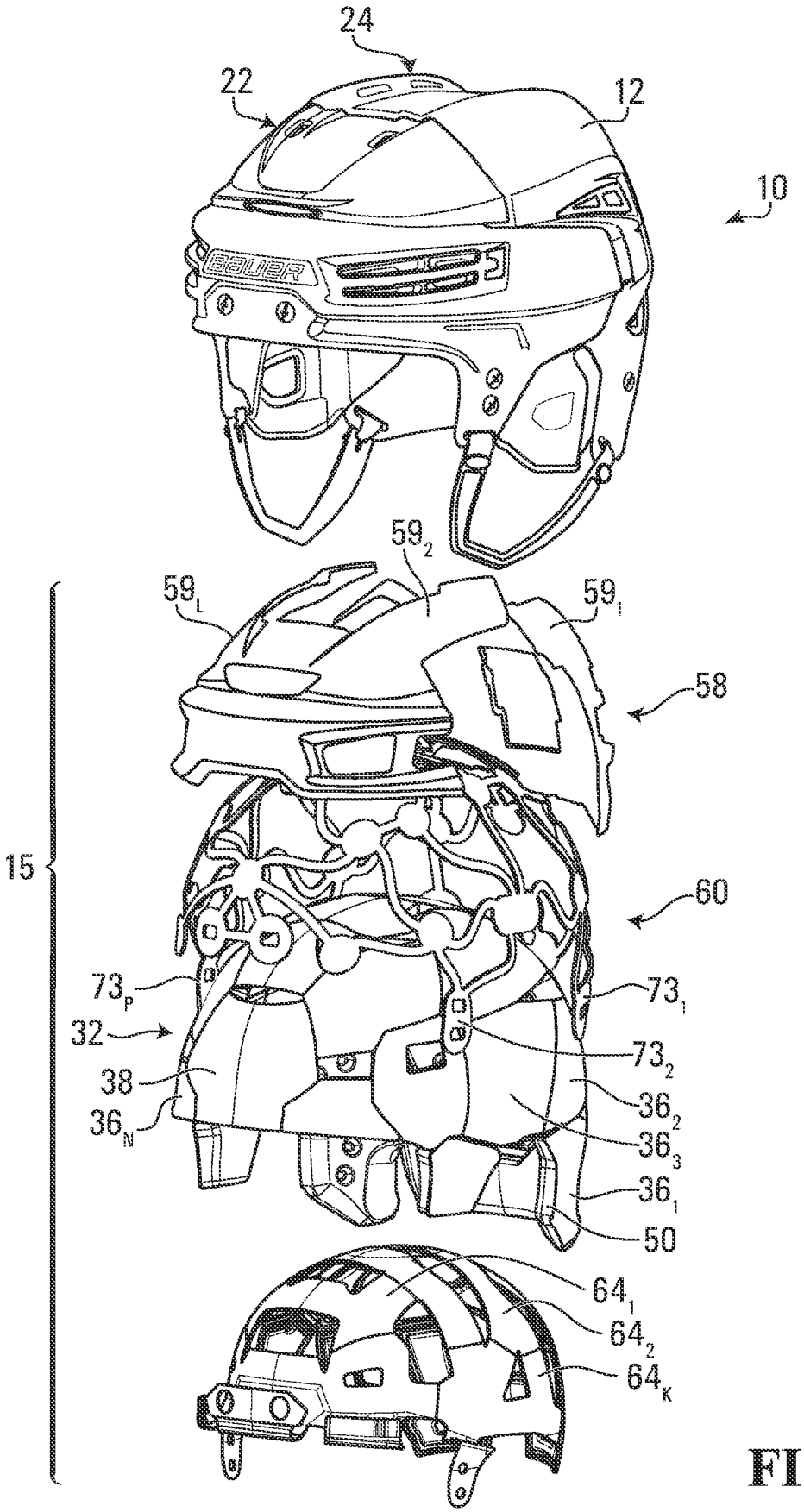
FIG. 16 shows a perspective exploded view of the helmet.
Figure 17A:
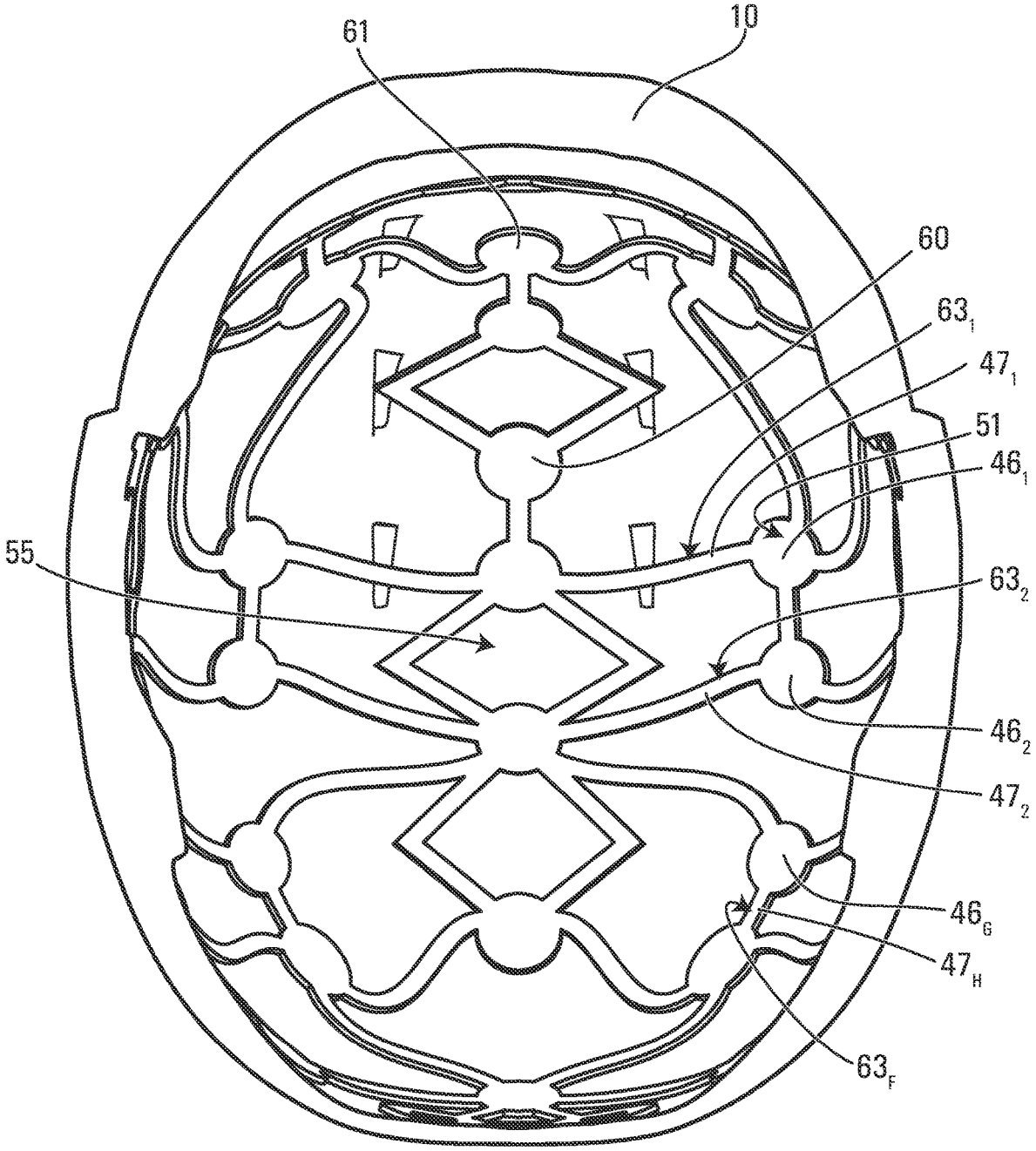
FIGS. 17A, 17B and 17C show inside views of various components of the helmet.
Figure 17B:
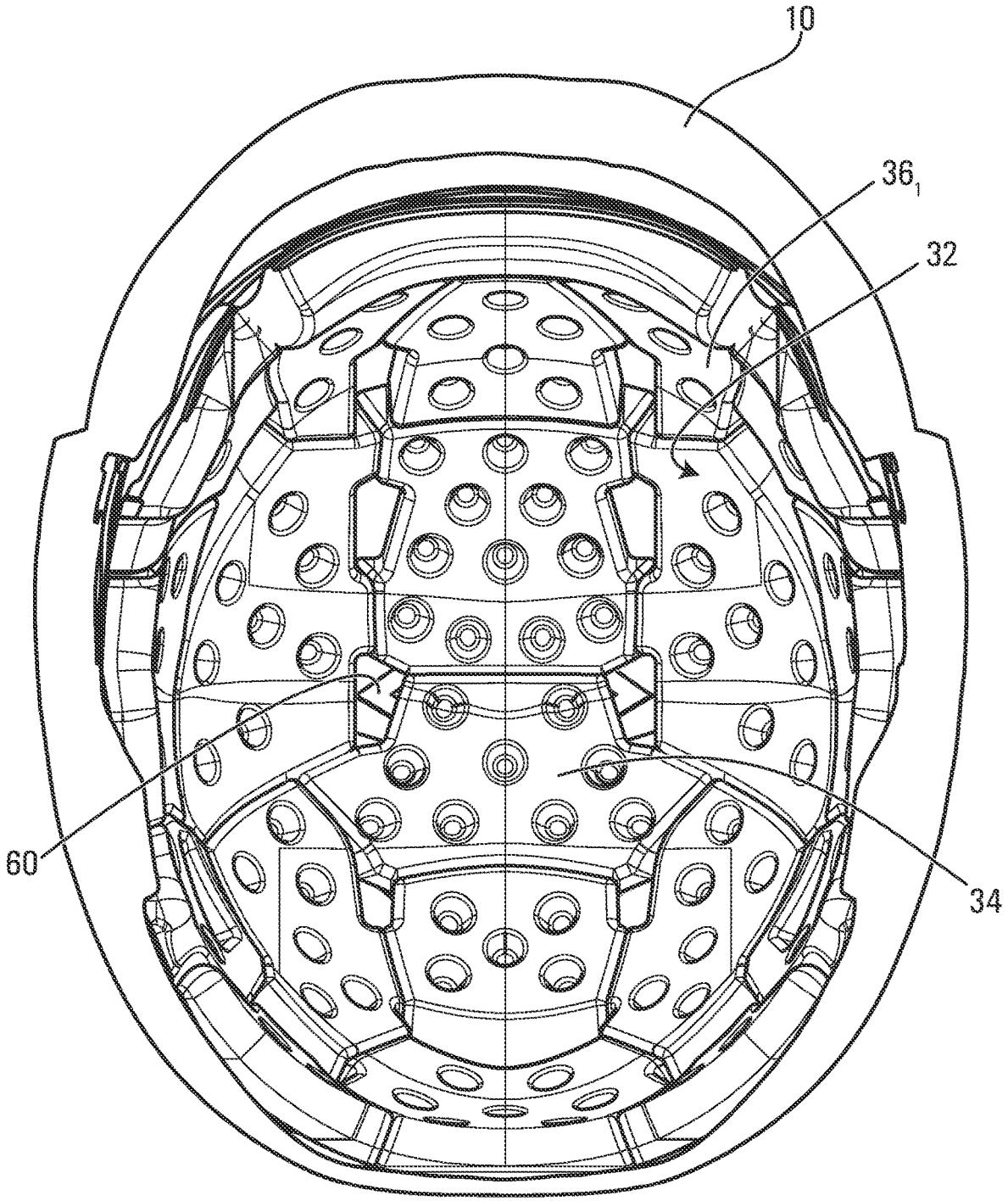
Figure 17C:
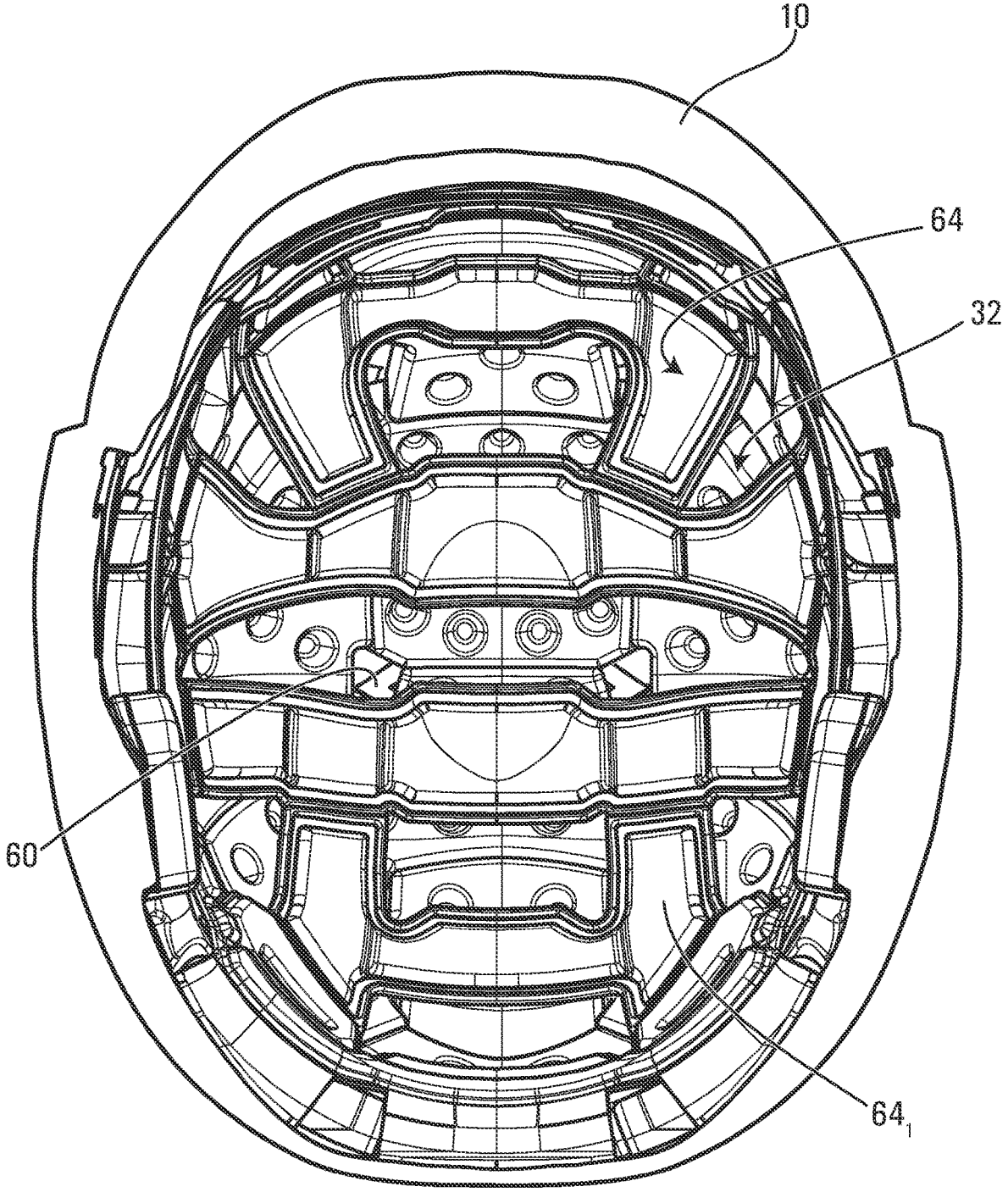

In this embodiment, the helmet 10 is adjustable to adjust how it fits on the wearer's head 11. To that end, the helmet 10 comprises an adjustment mechanism 40 for adjusting a fit of the helmet 10 on the wearer's head 11. The adjustment mechanism 40 allows the fit of the helmet 10 to be adjusted by adjusting one or more internal dimensions of the cavity 13 of the helmet 10, such as a front-back internal dimension FBD of the cavity 13 in the front-back direction of the helmet 10 and/or a left-right internal dimension LRD of the cavity 13 in the left-right direction of the helmet 10, as shown in FIG. 15.

Figure 1:
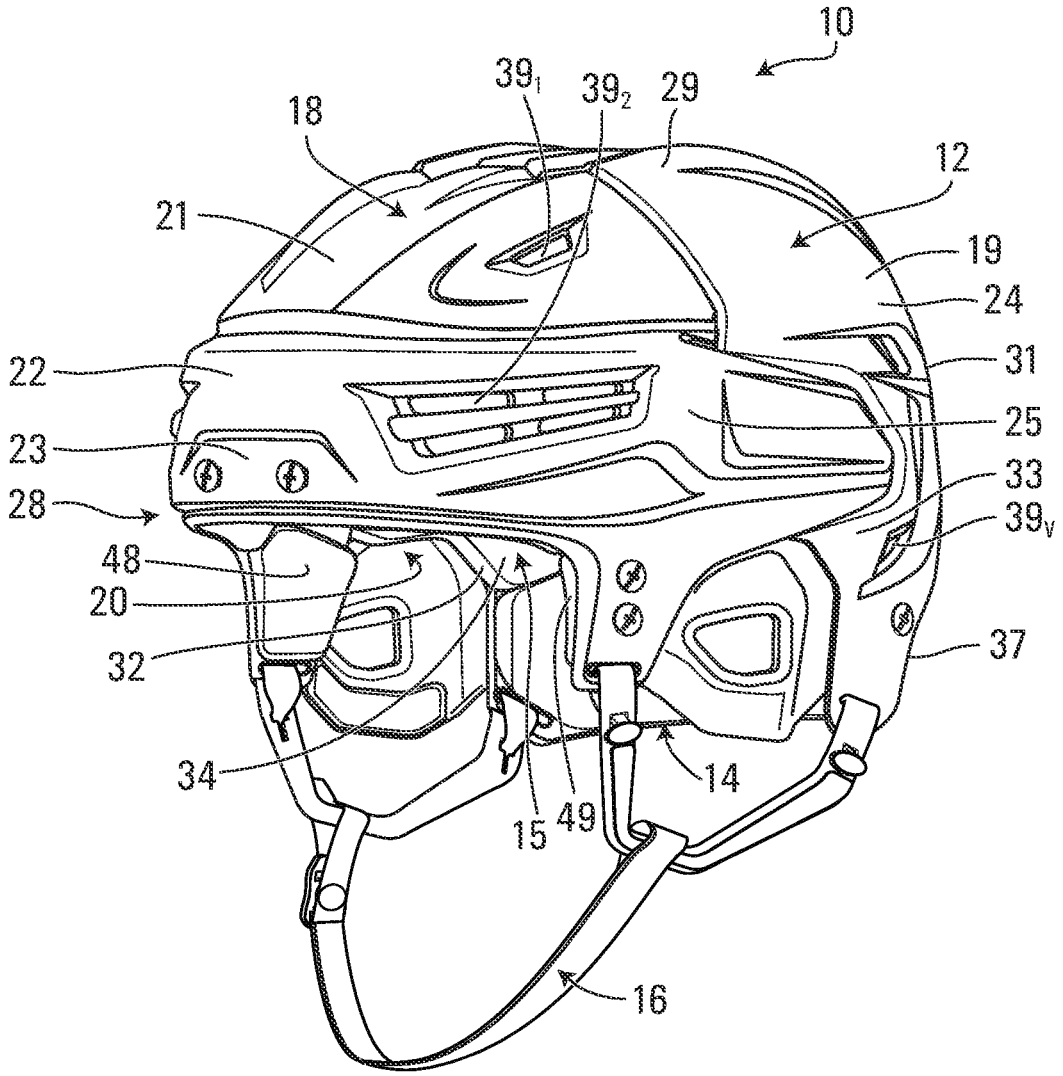
FIG. 1 shows an example of a helmet for protecting a head of a wearer in accordance with an embodiment of the invention.
Figure 2:
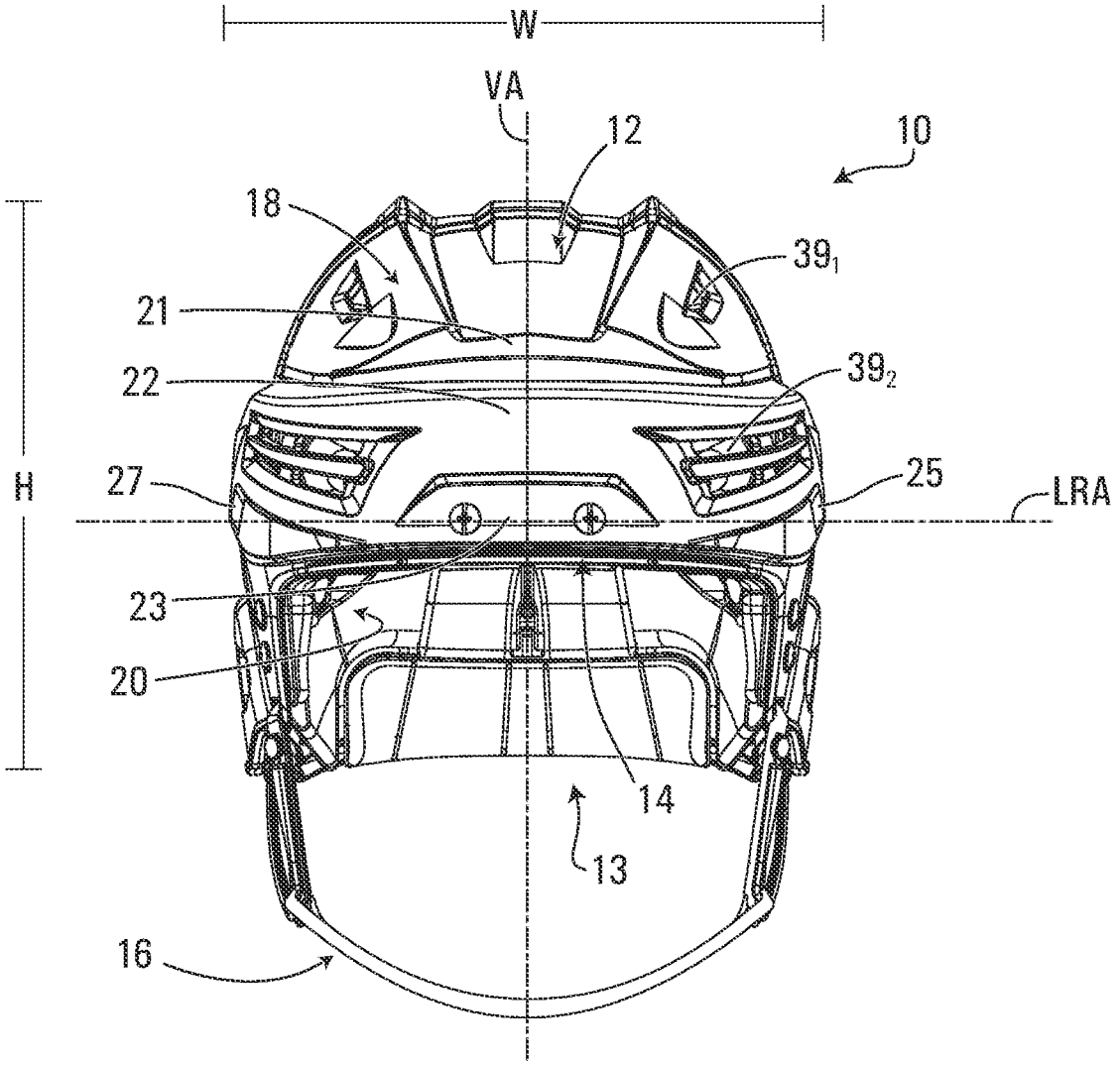
FIGS. 2 and 3 show a front and rear perspective view of the helmet.
Figure 3:
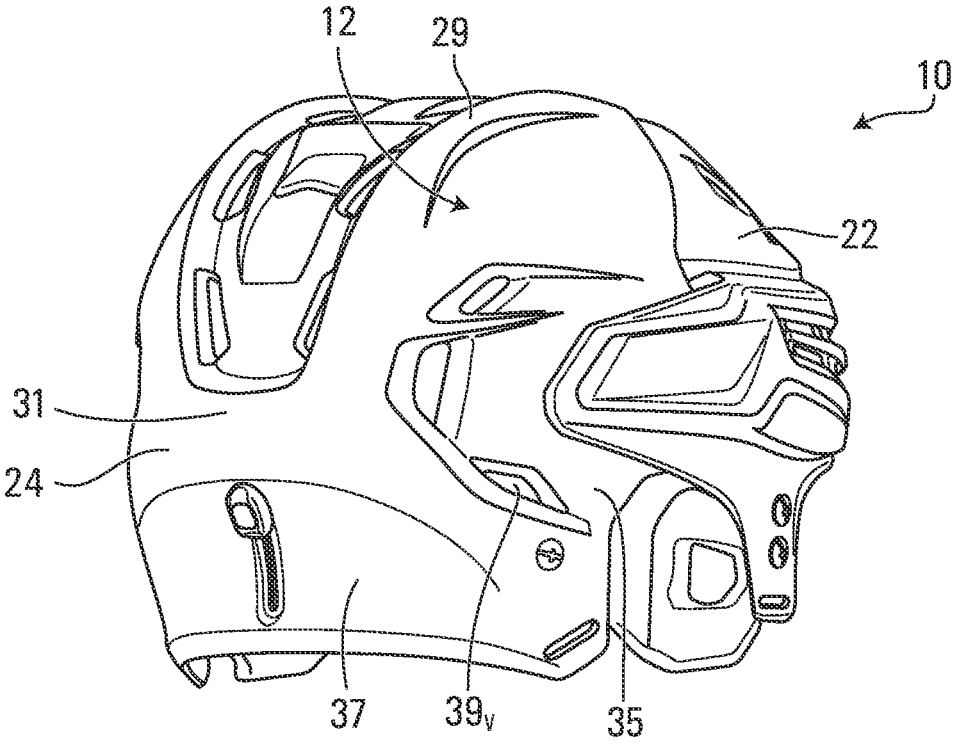
Figure 4:
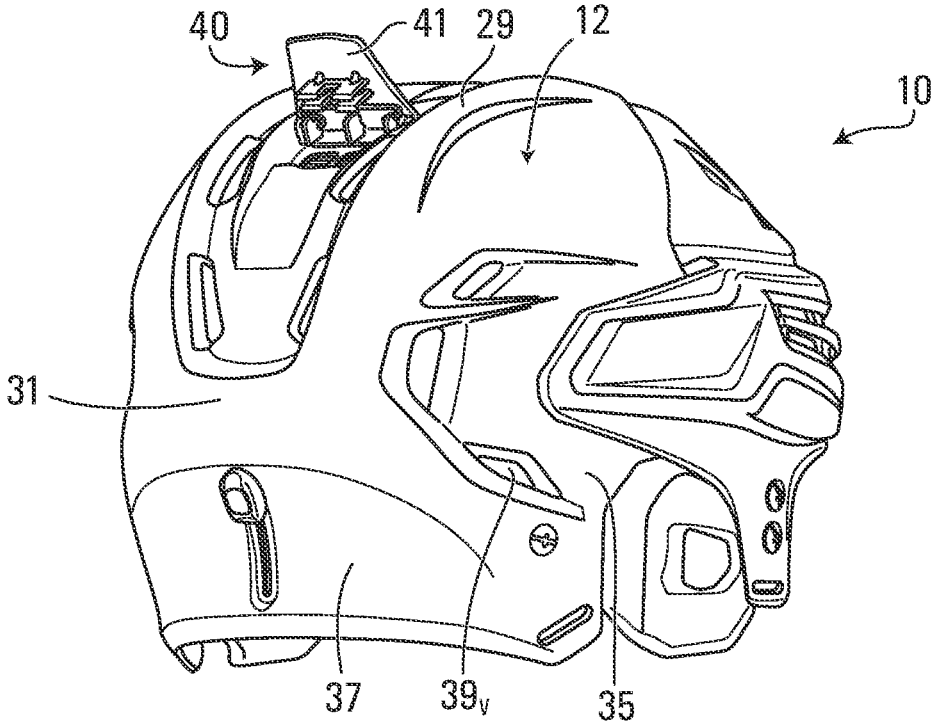
FIGS. 4 to 8 show operation of an example of an adjustment mechanism of the helmet.
Figure 5:
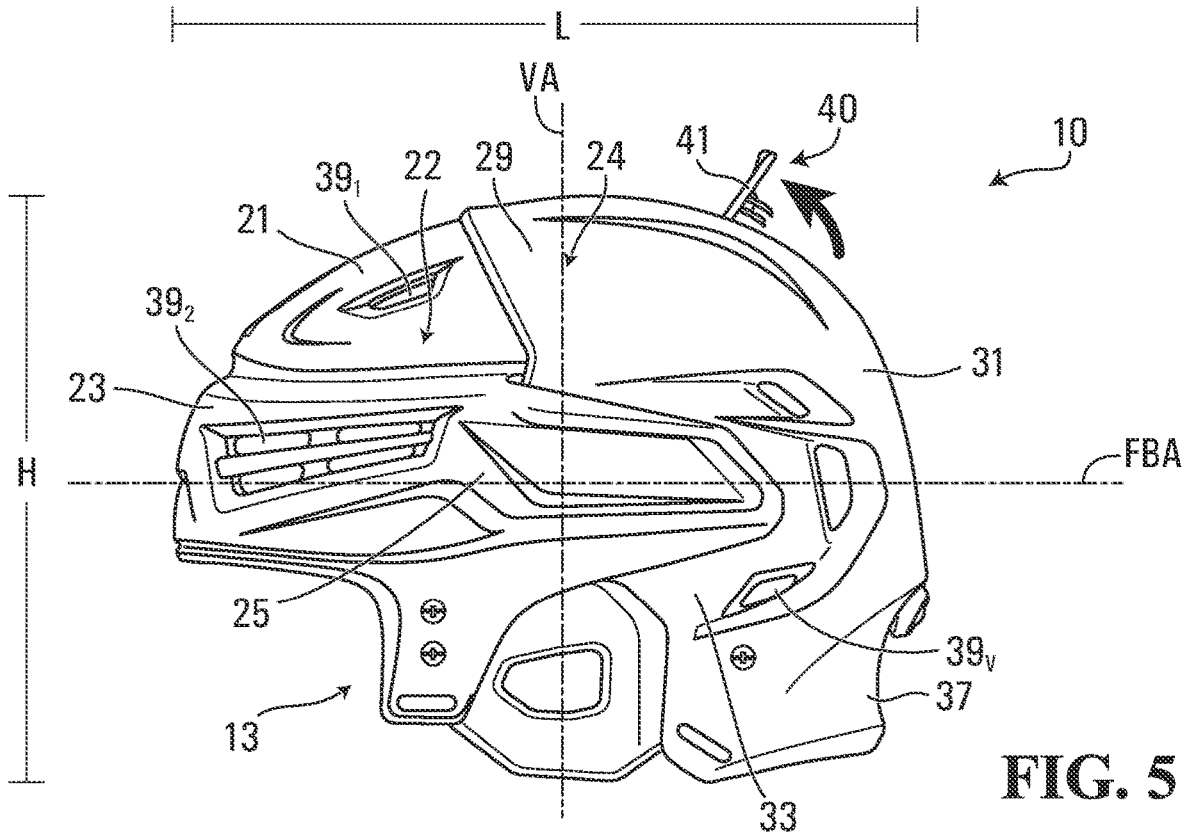
Figure 6:
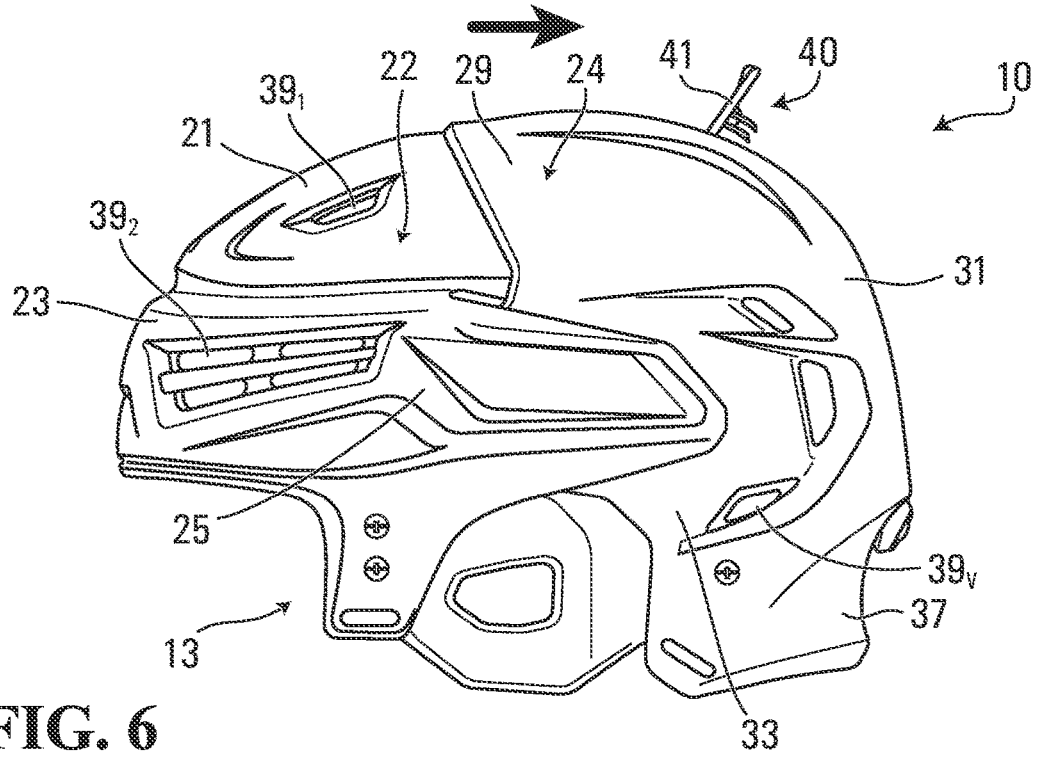
Figure 7:
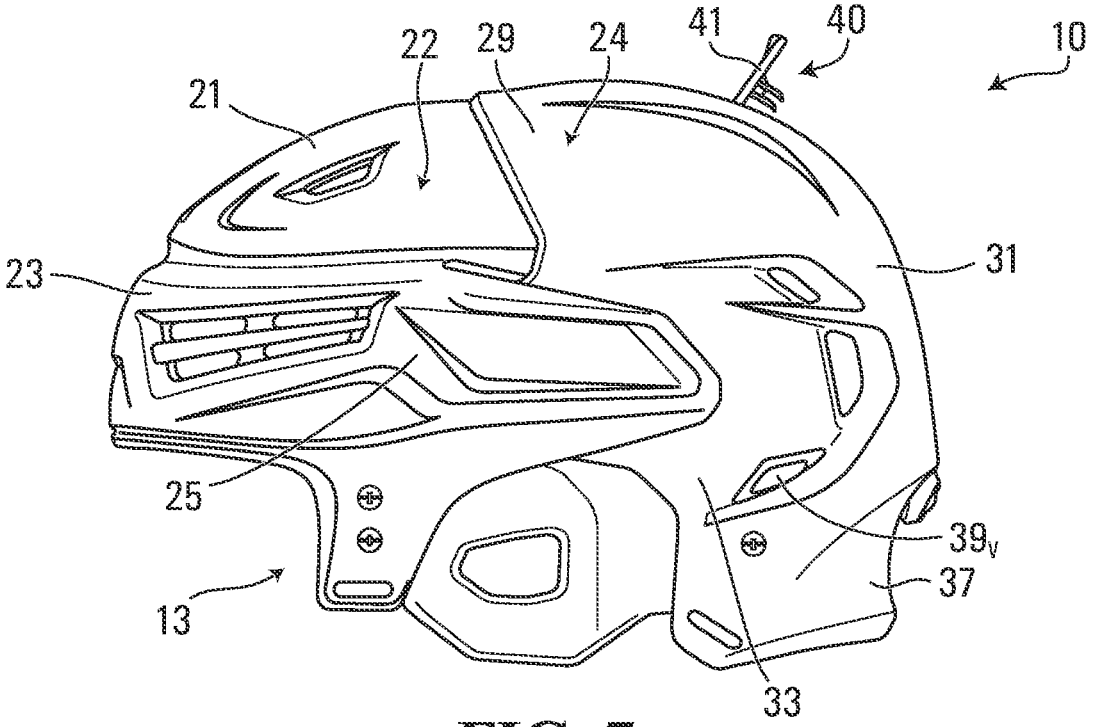
Figure 8:
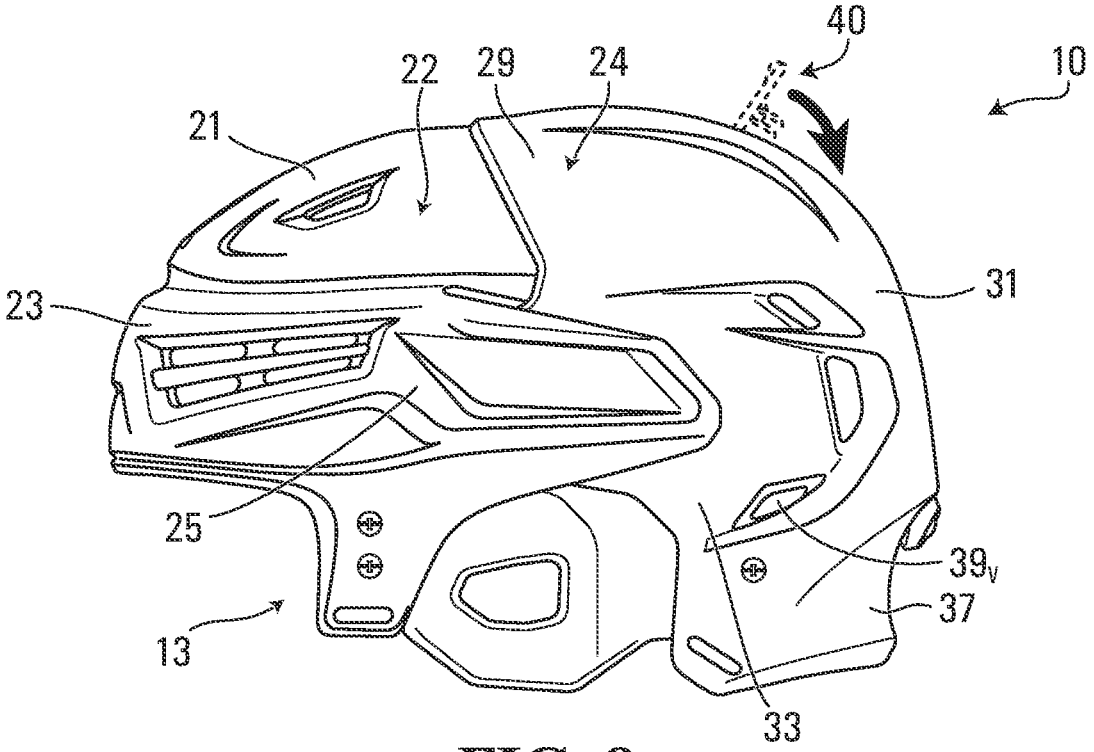

More particularly, in this embodiment, the outer shell 12 and the inner padding 15 are adjustable to adjust the fit of the helmet 10 on the wearer's head 11. To that end, in this case, the front outer shell member 22 and the rear outer shell member 24 are movable relative to one another to adjust the fit of the helmet 10 on the wearer's head 11. The adjustment mechanism 40 is connected between the front outer shell member 22 and the rear outer shell member 24 to enable adjustment of the fit of the helmet 10 by moving the outer shell members 22, 24 relative to one another. In this example, relative movement of the outer shell members 22, 24 for adjustment purposes is in the front-back direction of the helmet 10 such that the front-back internal dimension FBD of the cavity 13 of the helmet 10 is adjusted. This is shown in FIGS. 5 to 8 in which the rear outer shell member 24 is moved relative to the front outer shell member 22 from a first position, which is shown in FIG. 5 and which corresponds to a minimum size of the helmet 10, to a second position, which is shown in FIG. 6 and which corresponds to an intermediate size of the helmet 10, and to a third position, which is shown in FIGS. 7 and 8 and which corresponds to a maximum size of the helmet 10.

Figure 9:
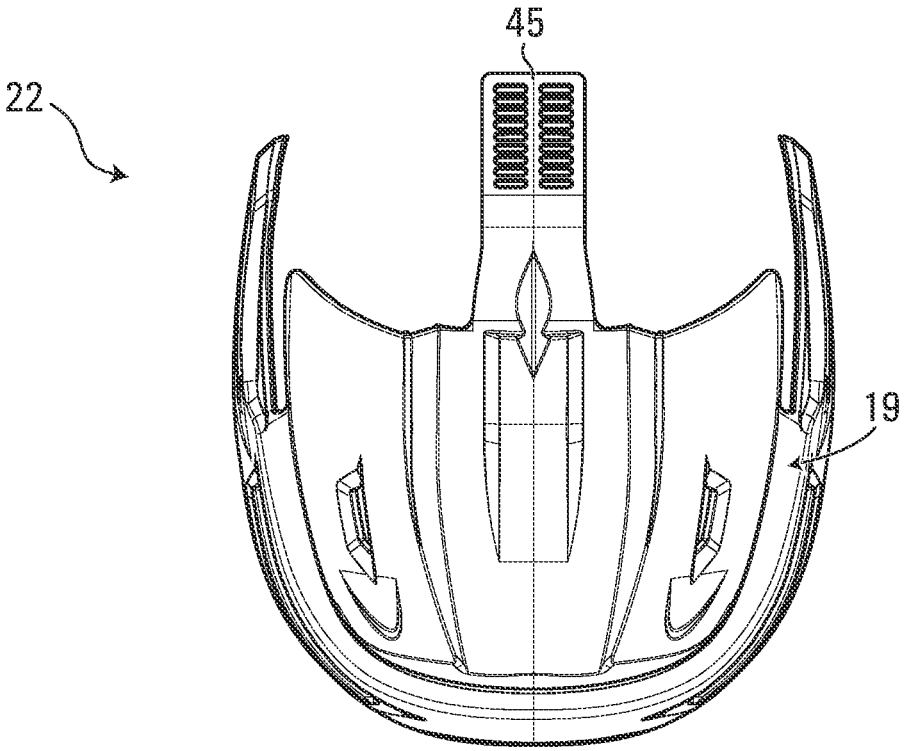
FIGS. 9 and 10 show an example of shell members of an outer shell of the helmet.
Figure 10:
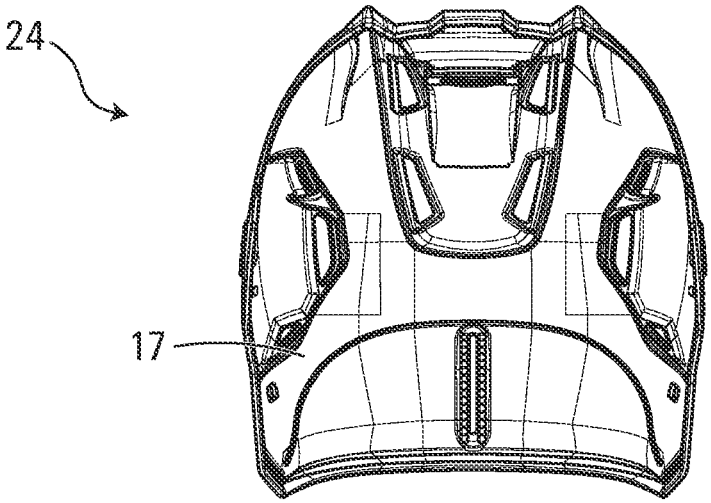

In this example of implementation, the adjustment mechanism 40 comprises an actuator 41 that can be moved (in this case pivoted) by the wearer between a locked position, in which the actuator 41 engages a locking part 45 (as best shown in FIGS. 9 and 10) of the front outer shell member 22 and thereby locks the outer shell members 22, 24 relative to one another, and a release position, in which the actuator 41 is disengaged from the locking part 45 of the front outer shell member 22 and thereby permits the outer shell members 22, 24 to move relative to one another so as to adjust the size of the helmet 10. The adjustment mechanism 40 may be implemented in various other ways in other embodiments.

In this embodiment, the outer shell 12 comprises a plurality of ventilation holes $39_1$-$39_v$ allowing air to circulate around the wearer's head 11 for added comfort. In this case, each of the front and rear outer shell members 22, 24 defines respective ones of the ventilation holes $39_1$-$39_v$ of the outer shell 12.

The outer shell 12 may be implemented in various other ways in other embodiments. For example, in other embodiments, the outer shell 12 may be a single-piece shell. In such embodiments, the adjustment mechanism 40 may comprise an internal adjustment device located within the helmet 10 and having a head-facing surface movable relative to the wearer's head 11 in order to adjust the fit of the helmet 10. For instance, in some cases, the internal adjustment device may comprise an internal pad member movable relative to the wearer's head 11 or an inflatable member which can be inflated so that its surface can be moved closer to or further from the wearer's head 11 to adjust the fit.

As shown in FIGS. 16 to 18B, the inner padding 15 is disposed between the outer shell 12 and the wearer's head 11 in use to absorb impact energy when the helmet 10 is impacted. More particularly, the inner padding 15 comprises a shock-absorbing structure 32 that includes an outer surface 38 facing towards the outer shell 12 and an inner surface 34 facing towards the wearer's head 11. The shock-absorbing structure 32 comprises a plurality of pads $36_1$-$36_N$ to absorb impact energy. The pads $36_1$-$36_N$ are responsible for absorbing at least a bulk of the impact energy transmitted to the inner padding 15 when the helmet 10 is impacted and can therefore be referred to as "absorption" pads.

For example, in this embodiment, each of the pads $36_1$-$36_N$ comprises a shock-absorbing material 50. For instance, in some cases, the shock-absorbing material 50 may include a polymeric cellular material, such as a polymeric foam (e.g., expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material), or expanded polymeric microspheres (e.g., Expancel™ microspheres commercialized by Akzo Nobel). In some cases, the shock-absorbing material 50 may include an elastomeric material (e.g., a rubber such as styrene-butadiene rubber or any other suitable rubber; a polyurethane elastomer such as thermoplastic polyurethane (TPU); any other thermoplastic elastomer; etc.). In some cases, the shock-absorbing material 50 may include a fluid (e.g., a liquid or a gas), which may be contained within a container (e.g., a flexible bag, pouch or other envelope) or implemented as a gel (e.g., a polyurethane gel). Any other material with suitable impact energy absorption may be used in other embodiments. In other embodiments, a given one of the pads $36_1$-$36_N$ may comprise an arrangement (e.g., an array) of shock absorbers that are configured to deform when the helmet 10 is impacted. For instance, in some cases, the arrangement of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

In some embodiments, the shock-absorbing material 50 of different ones of the pads $36_1$-$36_N$ may be different. For instance, in some embodiments, the shock-absorbing material 50 of two, three, four or more the pads $36_1$-$36_N$ may be different. For example, in some embodiments, the shock-absorbing material 50 of a pad $36_i$ may be different from the shock-absorbing material 50 of another pad $36_j$. For instance, in some cases, the shock-absorbing material 50 of the pad $36_i$ may be denser than the shock-absorbing material 50 of the pad $36_j$. Alternatively or additionally, in some cases, the shock-absorbing material 50 of the pad $36_i$ may be stiffer than the shock-absorbing material 50 of the pad $36_j$. Combinations of different densities, thickness and type of material for the pads $36_1$-$36_N$ may permit for better absorption of high- and low-energy impacts.

The absorption pads $36_1$-$36_N$ may be present in any suitable number. For example, in some embodiments, the plurality of absorption pads $36_1$-$36_N$ may include at least three pads, in some cases at least five pads, in some cases at least eight pads, and in some cases even more pads (e.g., at least ten pads or more).

In addition to the absorption pads $36_1$-$36_N$, in this embodiment, the inner padding 15 comprises comfort pads $64_1$-$64_K$ which are configured to provide comfort to the wearer's head. In this embodiment, when the helmet 10 is worn, the comfort pads $64_1$-$64_K$ are disposed between the absorption pads $36_1$-$36_N$ and the wearer's head 11 to contact the wearer's head 11. The comfort pads $64_1$-$64_K$ may comprise any suitable soft material providing comfort to the wearer. For example, in some embodiments, the comfort pads $64_1$-$64_K$ may comprise polymeric foam such as polyvinyl chloride (PVC) foam, polyurethane foam (e.g., PORON XRD foam commercialized by Rogers Corporation), vinyl nitrile foam or any other suitable polymeric foam material. In some embodiments, given ones of the comfort pads $64_1$-$64_K$ may be secured (e.g., adhered, fastened, etc.) to respective ones of the absorption pads $36_1$-$36_N$. In other embodiments, given ones of the comfort pads $64_1$-$64_K$ may be mounted such that they are movable relative to the absorption pads $36_1$-$36_N$. For example, in some embodiments, given ones of the comfort pads $64_1$-$64_K$ may be part of a floating liner as described in U.S. Patent Application Publication 2013/0025032, which, for instance, may be implemented as the SUSPEND-TECH™ liner found in the BAUER™ RE-AKT™ and RE-AKT 100™ helmets made available by Bauer Hockey, Inc. The comfort pads $64_1$-$64_K$ may assist in absorption of energy from impacts, in particular, low-energy impacts.

The absorption pads $36_1$-$36_N$ are configured to move relative to one another in response to an impact on the helmet 10. This may enhance protection. Notably, in response to a rotational impact on the helmet 10, the pads $\mathbf{36}_1$-$\mathbf{36}_N$ can move relative to one another, thus absorbing rotational energy from the rotational impact and reducing angular acceleration of the wearer's head 11.

In this embodiment, the inner padding 15 comprises a frame 60 carrying the pads $\mathbf{36}_1$-$\mathbf{36}_N$ and configured to allow the pads $\mathbf{36}_1$-$\mathbf{36}_N$ to move relative to one another in response to an impact on the helmet 10. In particular, in this embodiment, the frame 60 is disposed between the outer shell 12 and the pads $\mathbf{36}_1$-$\mathbf{36}_N$. More particularly, in this embodiment, the frame 60 comprises a plurality of frame members $\mathbf{63}_1$-$\mathbf{63}_F$ carrying respective ones of the pads $\mathbf{36}_1$-$\mathbf{36}_N$ and configured to move relative to one another in response to an impact on the helmet 10. More specifically, in this embodiment, the frame members $\mathbf{63}_1$-$\mathbf{63}_F$ are arranged into a network and respective ones of the pads $\mathbf{36}_1$-$\mathbf{36}_N$ are attached at nodes $\mathbf{46}_1$-$\mathbf{46}_G$ of the network. The plurality of frame members $\mathbf{63}_1$-$\mathbf{63}_F$ comprises a plurality of pad supports $\mathbf{46}_1$-$\mathbf{46}_G$ to which the respective ones of the pads $\mathbf{36}_1$-$\mathbf{36}_N$ are attached and a plurality of links $\mathbf{47}_1$-$\mathbf{47}_H$ interconnecting the pad supports $\mathbf{46}_1$-$\mathbf{46}_G$. In other words, in this embodiment, each of the pads $\mathbf{36}_1$-$\mathbf{36}_N$ is separately attached to the frame 60 at a respective one of multiple attachment points. In this example of implementation, each of the links $\mathbf{47}_1$-$\mathbf{47}_H$ is elongated. In this case, given ones of the links $\mathbf{47}_1$-$\mathbf{47}_H$ are curved. In this embodiment, each of the pad supports $\mathbf{46}_1$-$\mathbf{46}_G$ is located where respective ones of the links $\mathbf{47}_1$-$\mathbf{47}_H$ intersect. In some cases, a given one of the pad supports $\mathbf{46}_1$-$\mathbf{46}_G$ may be located where at least three of the links $\mathbf{47}_1$-$\mathbf{47}_H$ intersect. Each of the pad supports $\mathbf{46}_1$-$\mathbf{46}_G$ comprises an enlargement 51 where the respective ones of the links $\mathbf{46}_1$-$\mathbf{46}_G$ intersect.

In this embodiment, the frame 60 is deformable (i.e., changeable in configuration) to allow the pads $\mathbf{36}_1$-$\mathbf{36}_N$ to move relative to one another in response to the impact on the helmet 10. More particularly, in this embodiment, the frame 60 comprises a material 61 that allow deformation of the frame 60. The frame 60 may be resilient to allow the frame 60 to return to an original configuration after the frame 60 is bent, compressed, stretched or otherwise deformed into a different configuration in response to the impact on the helmet 10.

For example, in some embodiments, the material 61 of the frame 60 may have an elastic modulus (i.e., Young's modulus) of no more than 150 GPa in some cases no more than 100 GPa, in some cases no more than 50 GPa, in some cases no more than 25 GPa, in some cases no more than 10 GPa, in some cases no more than 5 GPa, in some cases no more than 1 GPa, in some cases no more than 0.1 GPa, and in some cases even less.

For instance, in some embodiments, the material 61 of the frame 60 may comprise a thermoplastic material, nylon, polycarbonate, acrylonitrile butadiene styrene (ABS), polyamide (PA), glass or carbon reinforced polypropylene (PP), and/or any other suitable material. Examples of suitable thermoplastic materials include rubber, high density VN foam, high density PE foam.

In this embodiment, the frame 60 is thinner than a given one of the pads $\mathbf{36}_1$-$\mathbf{36}_N$. For example, in some embodiments, a ratio of a thickness of the frame 60 over a thickness of the given one of the pads $\mathbf{36}_1$-$\mathbf{36}_N$ may be no more than 0.5, in some cases no more than 0.3, in some cases no more than 0.1, and in some cases even less.

The thickness of the pads $\mathbf{36}_1$-$\mathbf{36}_N$ may be constant or vary. For instance, the thickness of a given one of the pads $\mathbf{36}_1$-$\mathbf{36}_N$ may be constant or variable and/or the thickness of the pads $\mathbf{36}_1$-$\mathbf{36}_N$ may be constant or variable over multiple ones of the pads $\mathbf{36}_1$-$\mathbf{36}_N$. In particular, in some embodiments, the thickness of a first one of the pads $\mathbf{36}_1$-$\mathbf{36}_N$ may be different from and the thickness of a second one of the pads $\mathbf{36}_1$-$\mathbf{36}_N$.

The frame 60 may be mounted within the helmet 10 in any suitable way. In this embodiment, the frame 60 is connected to the outer shell 12. For instance, in this embodiment, the frame 60 includes a plurality of connectors $\mathbf{73}_1$-$\mathbf{73}_p$ for connecting the frame 60 to the outer shell 12. In this example, the connectors $\mathbf{73}_1$-$\mathbf{73}_p$ include apertures in the frame 60 which receive fasteners (e.g., screws, bolts, etc.) to connect the frame 60 to the outer shell 12. In other examples, the connectors $\mathbf{73}_1$-$\mathbf{73}_p$ may comprise projections of the frame 60 that are received in openings of the outer shell 12.

In this embodiment, the frame 60 is connected to a remainder of the helmet 10 in a lower edge region 14 of the helmet 10. The frame 60 may be unconnected to the remainder of the helmet 10 over a substantial part of a height $H_f$ of the frame 60. For instance, in some examples of implementation, the frame 60 may be unconnected to the remainder of the helmet 10 from an apex 55 of the frame 60 downwardly for at least one-quarter of the height $H_f$ of the frame 60, in some cases for at least one-third of the height $H_f$ of the frame 60, and in some cases for at least half of the height $H_f$ of the frame 60. In some embodiments, the frame 60 may connected to the remainder of the helmet 10 only in a bottom third of the height $H_f$ of the frame 60, in some cases only in a bottom quarter of the height $H_f$ of the frame 60, and in some cases only in a bottom fifth of the height $H_f$ of the frame 60.

Different ones of the pads $\mathbf{36}_1$-$\mathbf{36}_N$ are movable relative to one another in respect to an impact. In this embodiment, a given one of the pads $\mathbf{36}_1$-$\mathbf{36}_N$ is omnidirectionally movable (i.e., is movable in any direction) relative to another one of the pads $\mathbf{36}_1$-$\mathbf{36}_N$ in response to an impact.

A range of motion of a first one of the pads $\mathbf{36}_1$-$\mathbf{36}_N$ relative to a second one of the pads $\mathbf{36}_1$-$\mathbf{36}_N$ in response to the impact on the helmet 10 may be characterized in any suitable way in various embodiments.

For example, in some embodiments, the range of motion of the first one of the pads $\mathbf{36}_1$-$\mathbf{36}_N$ relative to the second one of the pads $\mathbf{36}_1$-$\mathbf{36}_N$ in response to the impact on the helmet 10 may correspond to at least 1% of the length L of the helmet 10, in some cases at least 3% of the length L of the helmet 10, in some cases at least 5% of the length L of the helmet 10, and in some cases even more. As another example, in some embodiments, the range of motion of the first one of the pads $\mathbf{36}_1$-$\mathbf{36}_N$ relative to the second one of the pads $\mathbf{36}_1$-$\mathbf{36}_N$ in response to the impact on the helmet 10 may correspond to at least 0.5% of the width W of the helmet 10, in some cases at least 1.5% of the width W of the helmet 10, in some cases at least 3% of the width W of the helmet 10, and in some cases even more.

For instance, in some embodiments, the range of motion of the first one of the pads $\mathbf{36}_1$-$\mathbf{36}_N$ relative to the second one of the pads $\mathbf{36}_1$-$\mathbf{36}_N$ in response to the impact on the helmet 10 may be at least 2.5 mm, in some cases at least 5 mm, in some cases at least 10 mm, and in some cases even more.

Resistance to deformation of the material 61 of the frame 60 and the geometry of the frame 60 may establish the limit of the displacement of the pads $\mathbf{36}_1$-$\mathbf{36}_N$.

In this embodiment, the inner padding 15 comprises a filler 58 disposed between the frame 60 and the inner surface 17 of the outer shell 12. More particularly, in this embodiment, the filler 58 comprises a plurality of filling pads $\mathbf{59}_1$-$\mathbf{59}_L$ adjacent to one another. As such, the filler 58 may have a variable thickness to create a homogeneous interface with the inner surface 17 of the outer shell 12. Thus, in this case, the filling pads $\mathbf{59}_1$-$\mathbf{59}_L$ may be of variable thicknesses. In some examples of implementation, the filler 58 comprises foam. In other examples of implementation, the filler 58 may comprise any suitable material (e.g., elastomeric material or any lightweight solid material such as EPP, EPE, Expancel, VN and PE foams). The pads $\mathbf{36}_1$-$\mathbf{36}_N$ are dimensioned to substantially cover an inner surface of the filler 58.

In other embodiments, the filler 58 may be omitted. For instance, in some embodiments, the frame 60 may directly interface with the inner surface 17 of the outer shell 12 and the pads $\mathbf{36}_1$-$\mathbf{36}_N$ may be dimensioned to substantially cover the inner surface 17 of the outer shell 12.

Figure 18A:
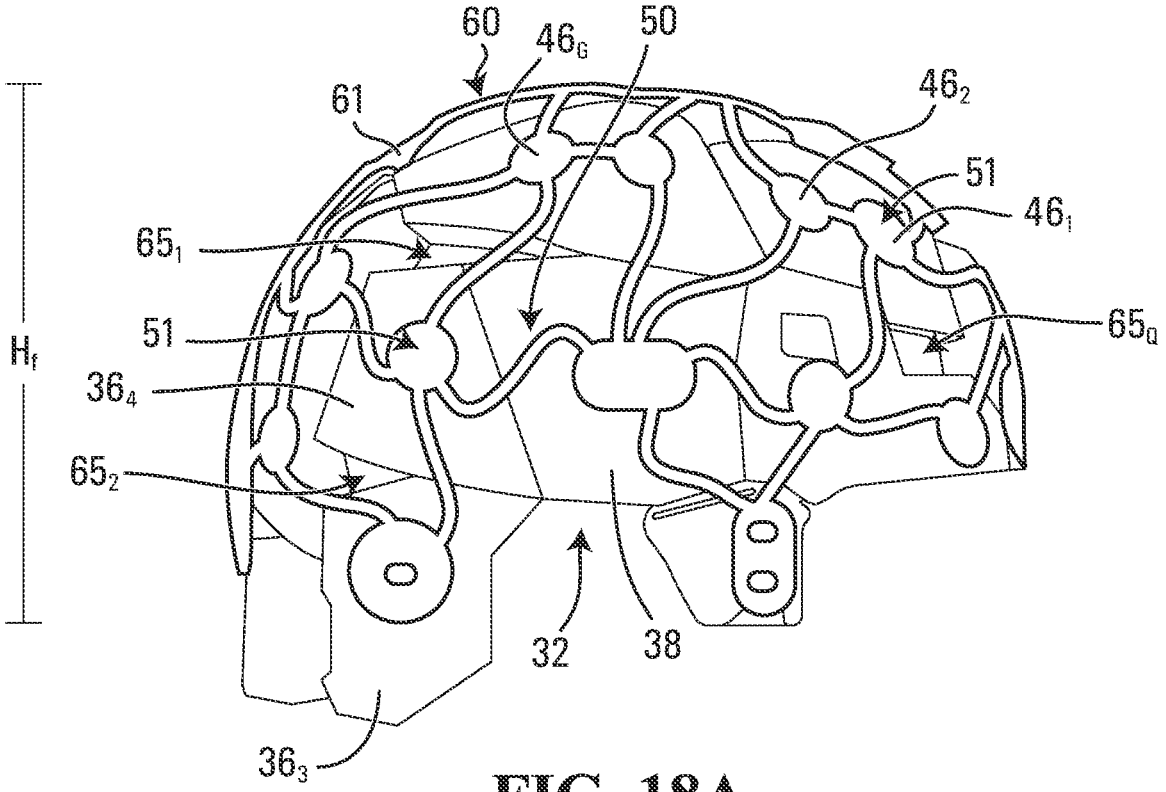
FIGS. 18A and 18B show an example of pads and a frame of the helmet in an open position and a closed position, respectively.
Figure 18B:
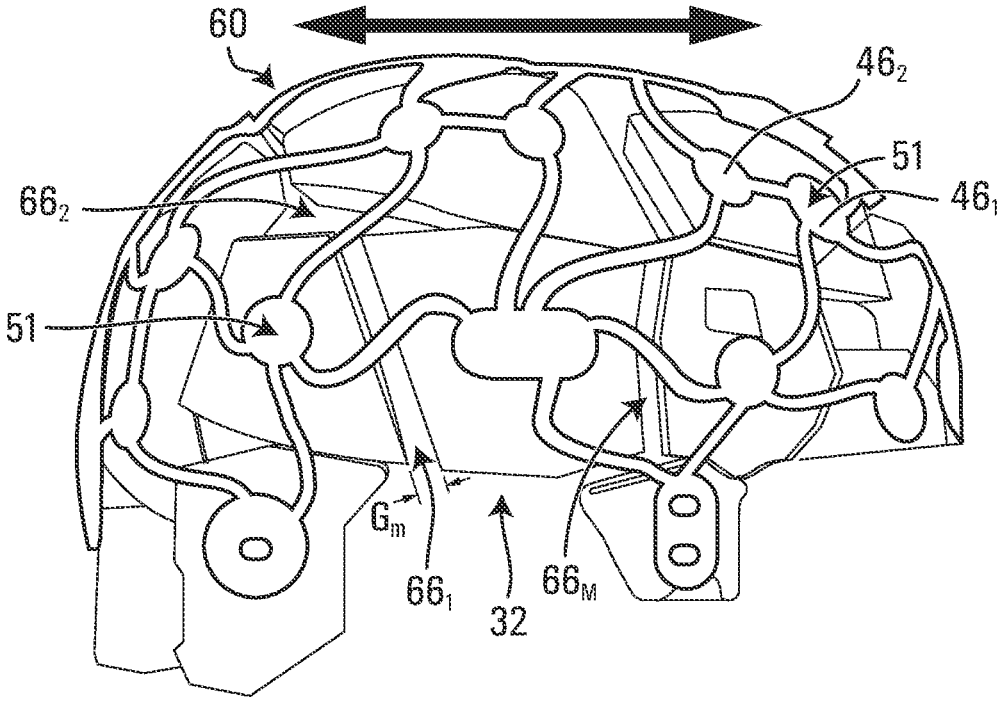
Figure 19:
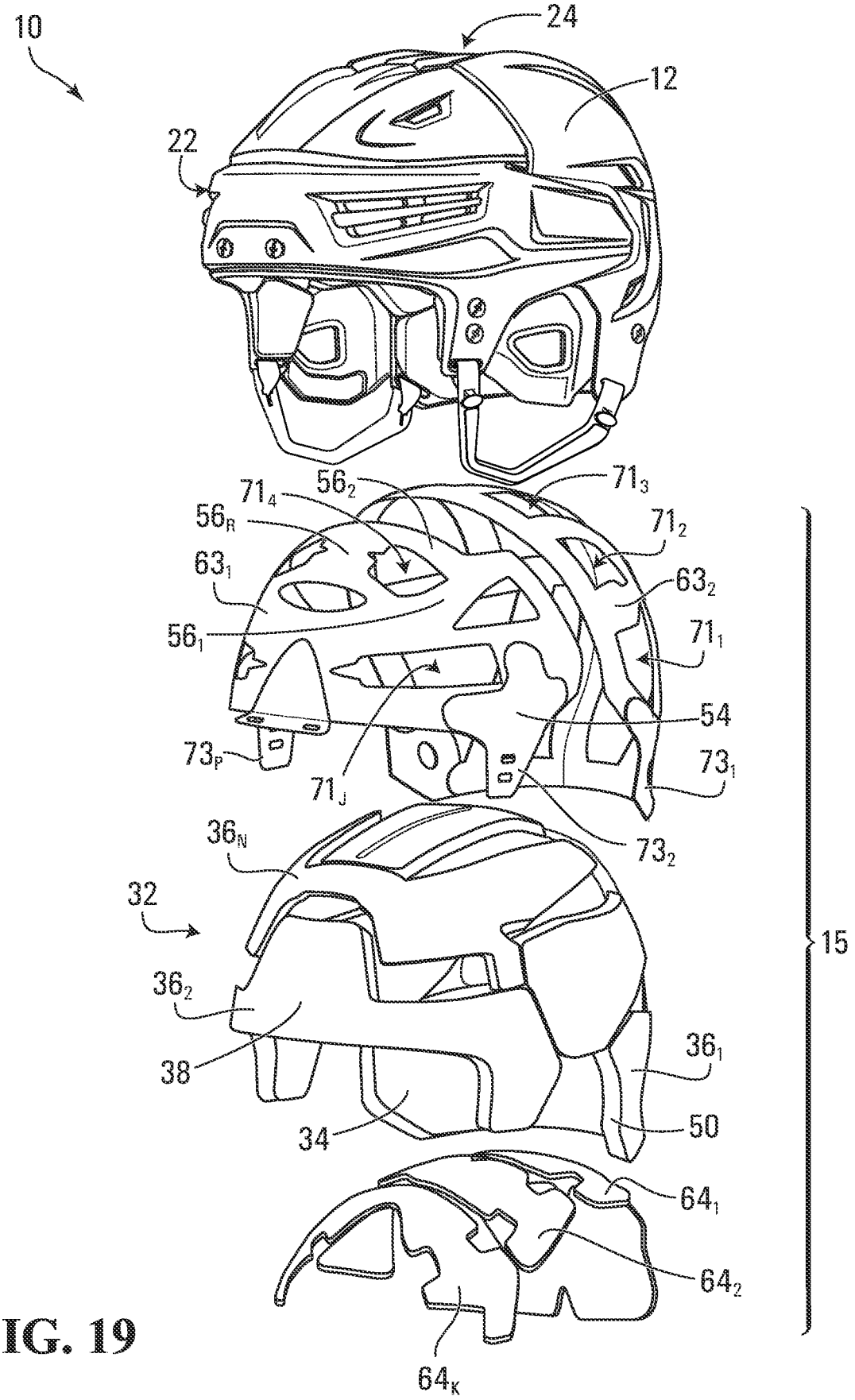
FIG. 19 shows a perspective exploded view of the helmet in accordance with another embodiment of the invention.
Figure 20A:
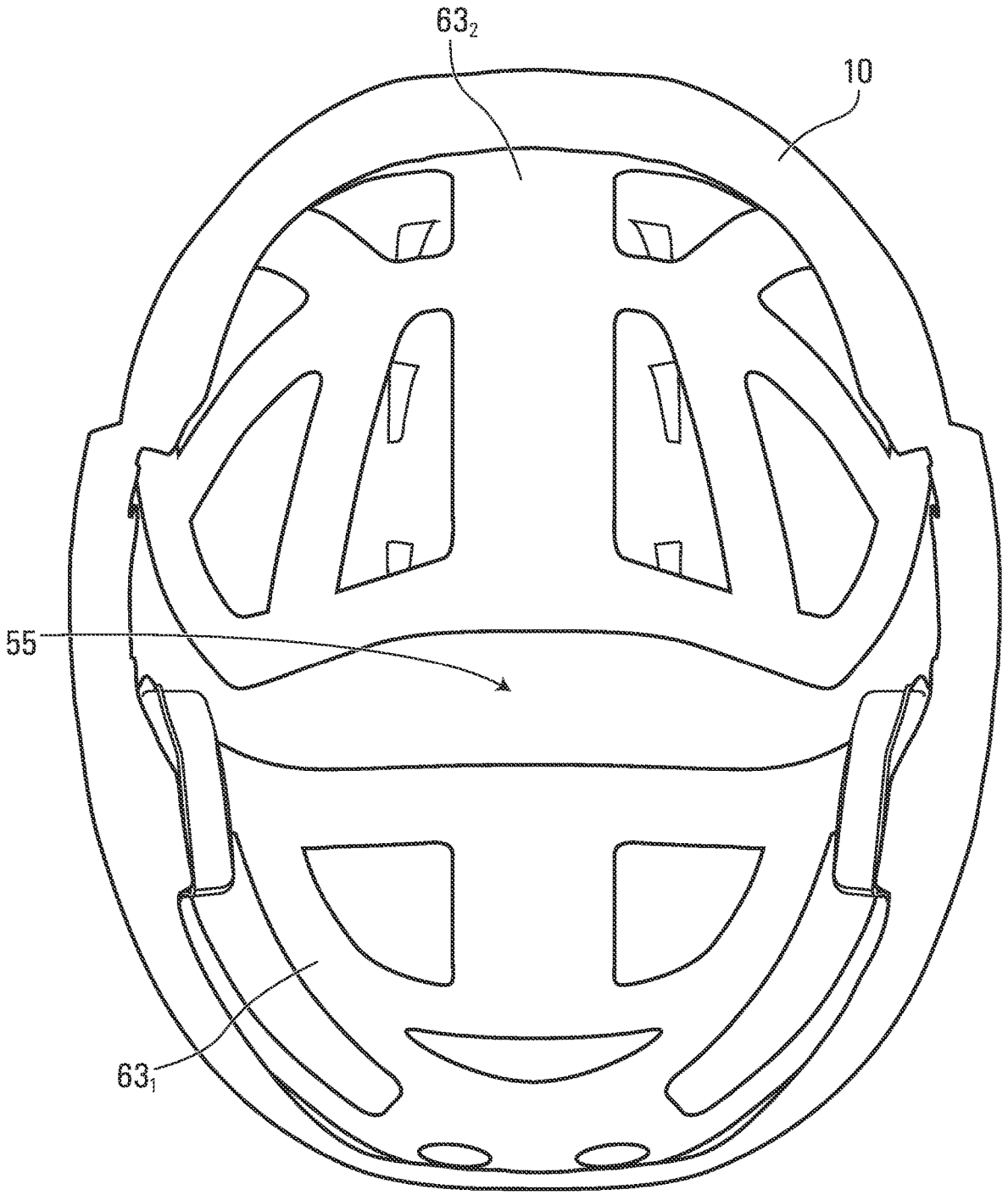
FIGS. 20A, 20B and 20C show inside views of components of the helmet of FIG. 19.
Figure 20B:
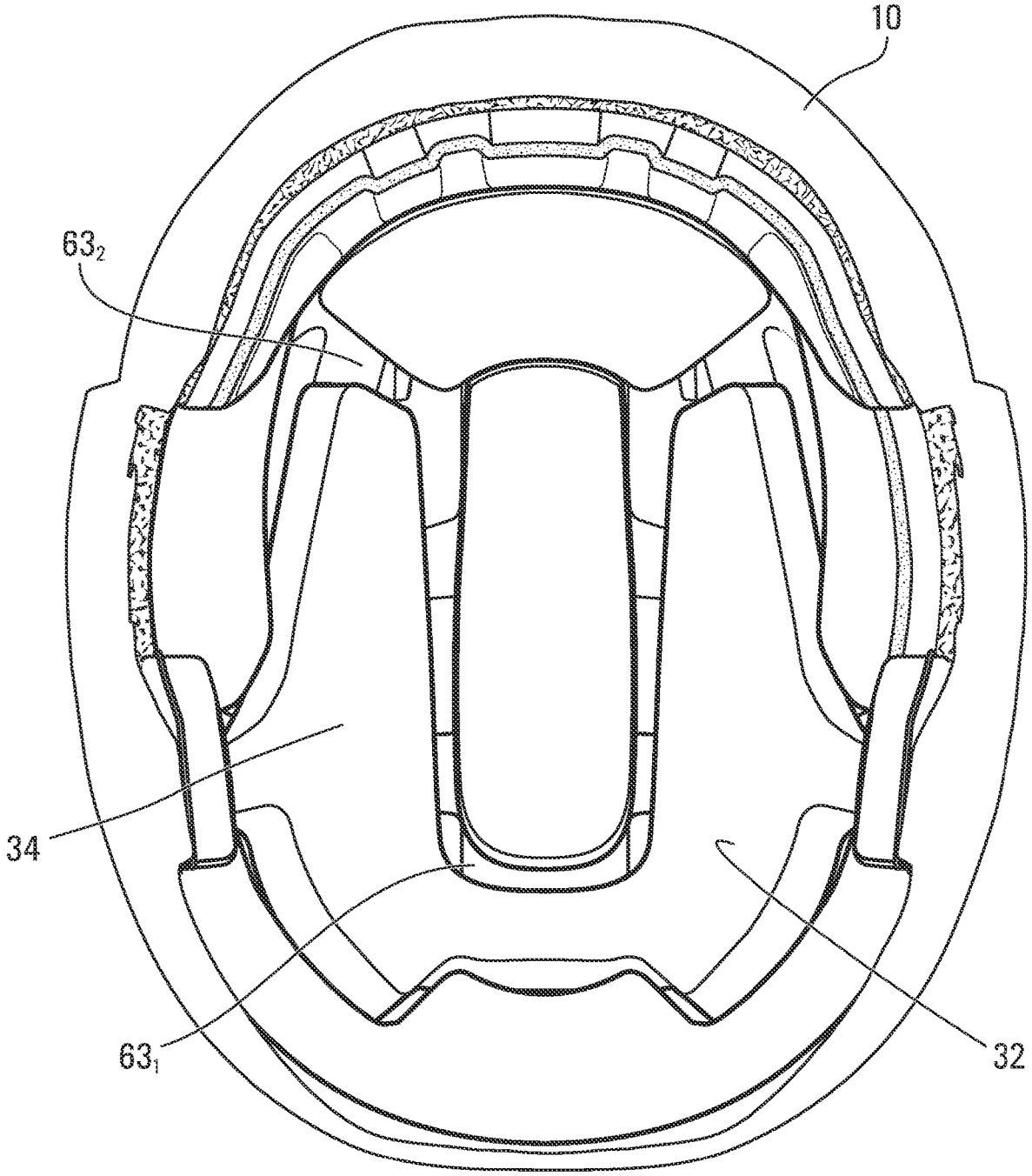
Figure 20C:
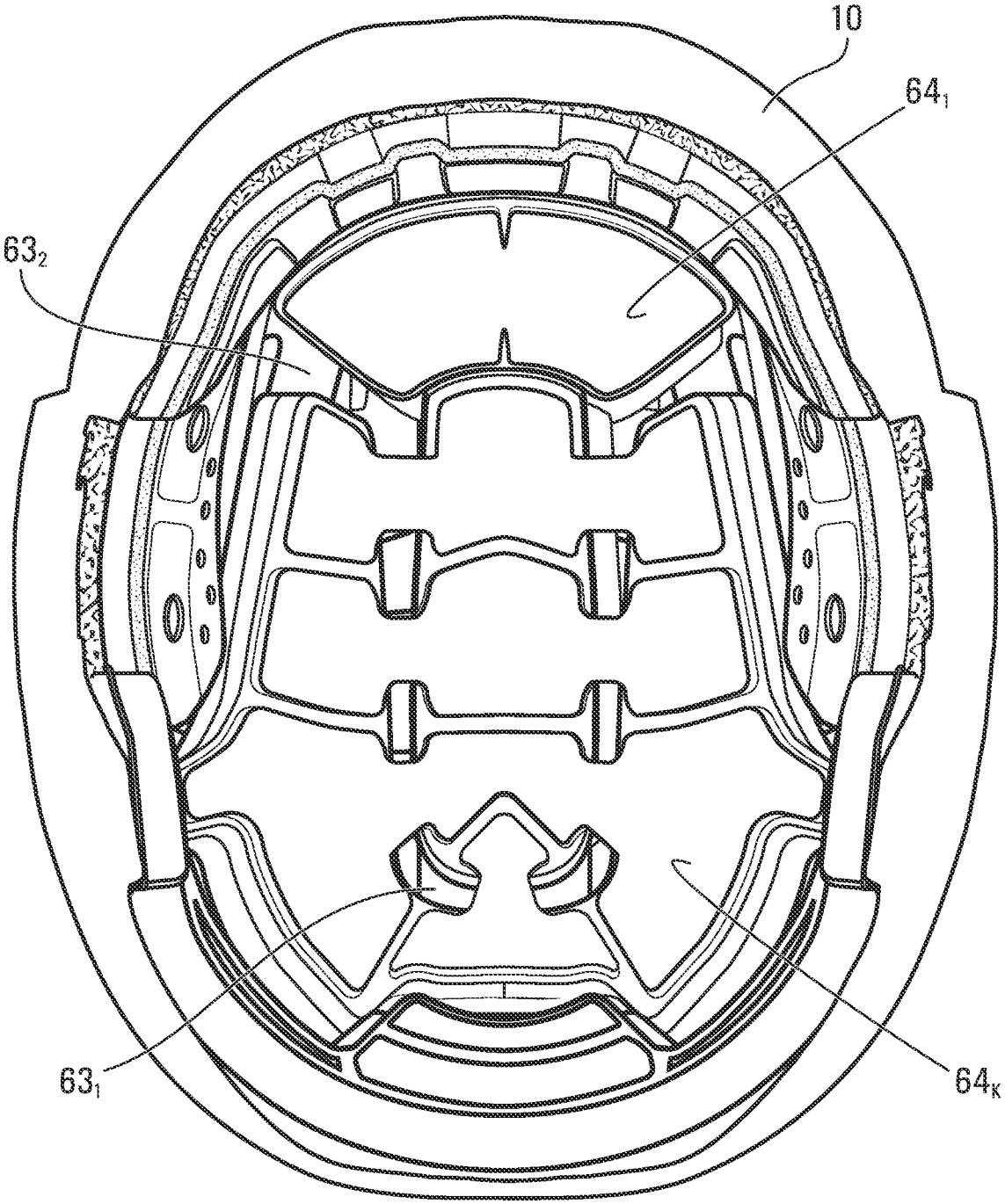

In this example of implementation where the helmet 10 includes the adjustment mechanism 40 to adjust the fit of the helmet 10 on the wearer's head 11, in some embodiments, when the adjustment mechanism 40 is operated to set a maximal size of the helmet 10, a maximal gap $G_m$ between adjacent ones of the pads $\mathbf{36}_1$-$\mathbf{36}_N$ may be no more than 10% of the length L of the helmet 10, in some cases no more than 5% of the length L of the helmet 10, in some cases no more than 3% of the length L of the helmet 10, and in some cases even less. With reference to FIG. 18B, the maximal gap $G_m$ between adjacent ones of the pads $\mathbf{36}_1$-$\mathbf{36}_N$ can be defined as the maximum distance of gaps $\mathbf{66}_1$-$\mathbf{66}_M$ between adjacent ones of the pads $\mathbf{36}_1$-$\mathbf{36}_N$ when the adjustment mechanism 40 is operated to set the maximal size of the helmet 10. For instance, in some embodiments, when the adjustment mechanism 40 is operated to set the maximal size of the helmet 10, the maximal gap $G_m$ between adjacent ones of the pads $\mathbf{36}_1$-$\mathbf{36}_N$ may be no more than 20 mm, in some cases no more than 10 mm, in some cases no more than 5 mm, and in some cases even less.

In this embodiment, the configuration of the pads $\mathbf{36}_1$-$\mathbf{36}_N$ may thus permit some displacement, in all directions, of one or more of the pads $\mathbf{36}_1$-$\mathbf{36}_N$ in response to an impact such as a rotational impact. With reference to FIGS. 18A and 18B, the frame 60 and the pads $\mathbf{36}_1$-$\mathbf{36}_N$ may reduce the size of the maximal gap $G_m$ between adjacent ones of the pads $\mathbf{36}_1$-$\mathbf{36}_N$ when the adjustment mechanism 40 is operated to set the maximal size of the helmet 10 in comparison to conventional adjustable helmets. In particular, FIG. 18A shows the helmet 10 is in a closed position, that corresponds to the minimum size of the helmet 10, and where there are substantially no gaps between adjacent ones of the pads $\mathbf{36}_1$-$\mathbf{36}_N$; although, FIG. 18A does show some gaps $\mathbf{65}_1$-$\mathbf{65}_Q$, these gaps $\mathbf{65}_1$-$\mathbf{65}_Q$ are typically less than the maximal gap $G_m$. Moreover, FIG. 18B shows the helmet 10 is in an open position, that corresponds to the maximum size of the helmet 10, and where there are gaps $\mathbf{66}_1$-$\mathbf{66}_M$ between adjacent ones of the pads $\mathbf{36}_1$-$\mathbf{36}_N$. Conventional adjustable helmets may have weaker absorption points as opening of the conventional adjustable helmets may create gaps on the side and on the top of the helmet where there is no absorption lining or foam. In this case, with the use of the frame 60 and the pads $\mathbf{36}_1$-$\mathbf{36}_N$, the gaps $\mathbf{66}_1$-$\mathbf{66}_M$ are generally divided between adjacent ones of the pads $\mathbf{36}_1$-$\mathbf{36}_N$ and the gaps $\mathbf{66}_1$-$\mathbf{66}_M$ are typically less than the gaps created in conventional adjustable helmets.

The helmet 10, including the frame 60 and the pads $\mathbf{36}_1$-$\mathbf{36}_N$ that are movable relative to one another, may be implemented in any other suitable way in other embodiments.

For example, in other embodiments, as shown in FIGS. 19 to 22, the helmet 10 comprises the absorption pads $\mathbf{36}_1$-$\mathbf{36}_N$, the frame 60 carrying the absorption pads $\mathbf{36}_1$-$\mathbf{36}_N$, and the comfort pads $\mathbf{64}_1$-$\mathbf{64}_K$ according to a variant.

In this embodiment, the plurality of frame members $\mathbf{63}_1$-$\mathbf{63}_F$ of the frame 60 includes a front frame member $\mathbf{63}_1$ and a rear frame member $\mathbf{63}_2$. In contrast to previous embodiments, in this example, the frame members $\mathbf{63}_1$-$\mathbf{63}_F$ are separate pieces instead of being interconnected to form a network. Although in this embodiment the plurality of frame members $\mathbf{63}_1$-$\mathbf{63}_F$ consists of two separate frame members $\mathbf{63}_1$ $\mathbf{63}_2$, in other embodiments the plurality of frame members $\mathbf{63}_1$-$\mathbf{63}_F$ may be more than two member.

In this embodiment, the front frame member $\mathbf{63}_1$ extends in a front part of the helmet 10 and carries front ones of the pads $\mathbf{36}_1$-$\mathbf{36}_N$ and the rear frame member $\mathbf{63}_2$ extends in a rear part of the helmet and carries rear ones of the pads $\mathbf{36}_1$-$\mathbf{36}_N$. That is, in this embodiment, the front frame member $\mathbf{63}_1$ carries a first set of one or more of the pads $\mathbf{36}_1$-$\mathbf{36}_N$ and the rear frame member $\mathbf{63}_2$ carries a second set of one or more of the pads $\mathbf{36}_1$-$\mathbf{36}_N$ where the pads in each of the first set and the second set are separate pads. In this example, each of the pads $\mathbf{36}_1$-$\mathbf{36}_N$ is attached either to the front frame member $\mathbf{63}_1$ or to the rear frame member $\mathbf{63}_2$ but not to both of the front frame member $\mathbf{63}_1$ and to the rear frame member $\mathbf{63}_2$. That is, each of the pads $\mathbf{36}_1$-$\mathbf{36}_N$ is attached to a given one of the front frame member $\mathbf{63}_1$ and to the rear frame member $\mathbf{63}_2$ and is not attached to the other one of the front frame member $\mathbf{63}_1$ and the rear frame member $\mathbf{63}_2$. Each of the pads $\mathbf{36}_1$-$\mathbf{36}_N$ may be attached to a respective one of the front frame member $\mathbf{63}_1$ and to the rear frame member $\mathbf{63}_2$ in any suitable way (e.g., by an adhesive, by a fastener such as a screw, etc.).

More particularly, in this embodiment, the front frame member $\mathbf{63}_1$ overlies at least part of the front region FR, the top region TR, and the left and right side regions LS, RS of the wearer's head 11, while the rear frame member $\mathbf{63}_2$ overlies at least part of the back region BR of the wearer's head 11 when the helmet 10 is worn. Each of the front frame member $\mathbf{63}_1$ and the rear frame member $\mathbf{63}_2$ includes a plurality of openings $\mathbf{71}_1$-$\mathbf{71}_J$. This may facilitate deformation (i.e., change in configuration) of portions $\mathbf{56}_1$-$\mathbf{56}_R$ of each of the front frame member $\mathbf{63}_1$ and the rear frame member $\mathbf{63}_2$ defined between the openings $\mathbf{71}_1$-$\mathbf{71}_J$ in response to an impact to allow movement of the pads $\mathbf{36}_1$-$\mathbf{36}_N$. The frame 60, notably the front frame member $\mathbf{63}_1$ and the rear frame member $\mathbf{63}_2$, may be molded in foam or in pieces of flat molded thermoplastic and assembled to provide the frame 60.

In this embodiment, the inner padding 15 includes a plurality of connectors $\mathbf{73}_1$-$\mathbf{73}_p$ connecting the frame 60 to the outer shell 12. In this embodiment, the connectors $\mathbf{73}_1$-$\mathbf{73}_p$ are deformable (i.e., changeable in configuration) to allow the front frame member $\mathbf{63}_1$ and the rear frame member $\mathbf{63}_2$ and thus the pads $\mathbf{36}_1$-$\mathbf{36}_N$ to move relative to one another in response to an impact on the helmet. In this case, each of the connectors $\mathbf{73}_1$-$\mathbf{73}_p$ is elastically stretchable to allow the pads $\mathbf{36}_1$-$\mathbf{36}_N$ to move relative to one another in response to the impact on the helmet 10.

More particularly, in this embodiment, each connector $\mathbf{73}_I$ comprises a material 54 that allows deformation of the connector $\mathbf{73}_I$ in response to an impact on the helmet 10. The connector $\mathbf{73}_I$ may be resilient to allow the connector $\mathbf{73}_I$ to return to an original configuration after the connector $\mathbf{73}_I$ is bent, compressed, stretched or otherwise deformed into a different configuration in response to the impact on the helmet 10.

For example, in some embodiments, the material 54 of the connector $\mathbf{73}_I$ may have an elastic modulus (i.e., Young's modulus) of no more than 0.1 GPa, in some cases no more than 0.05 GPa, in some cases no more than 0.01 GPa, and in some cases even less. It is appreciated that the elastic module may vary depending on the range of the type of material 54 used for the connector material $\mathbf{73}_I$ in various embodiments.

For instance, in some embodiments, the material 54 of the connector $\mathbf{73}_I$ may be an elastomeric material which may include rubber, thermoplastic elastomer (TPE) (e.g., TPE-U, TPE-S ,TPE-E, TPE-A, TPE-O, TPE-V) or any other suitable material.

In this embodiment, therefore, the configuration of the pads $\mathbf{36}_1$-$\mathbf{36}_N$ permits some displacement, in all directions, of one or more of the pads $\mathbf{36}_1$-$\mathbf{36}_N$ in response to an impact and, in particular, a rotational impact. Resistance to deformation of the material 54 of the connectors $\mathbf{73}_1$-$\mathbf{73}_p$ may establish the limit of the displacement of the pads $\mathbf{36}_1$-$\mathbf{36}_N$.

In this embodiment, the front frame member $\mathbf{63}_1$ is connected to the first shell member 22 of the outer shell 12 via respective ones of the connectors $\mathbf{73}_1$-$\mathbf{73}_p$ and the rear frame member $\mathbf{63}_2$ is connected to the second shell member 24 of the outer shell 12 via other ones of the connectors $\mathbf{73}_1$-$\mathbf{73}_p$. As each of the pads $\mathbf{36}_1$-$\mathbf{36}_N$ is only attached to one of the front frame member $\mathbf{63}_1$ and the rear frame member $\mathbf{63}_2$, when the first shell member 22 and the second shell member 24 are moved relative to one another by operating the adjustment mechanism 40, the first set of one or more of the pads $\mathbf{36}_1$-$\mathbf{36}_N$ which is attached to the front frame member $\mathbf{63}_1$ moves relative to the second set of one or more of the pads $\mathbf{36}_1$-$\mathbf{36}_N$ which is attached to the rear frame member $\mathbf{63}_2$.

Figure 21A:
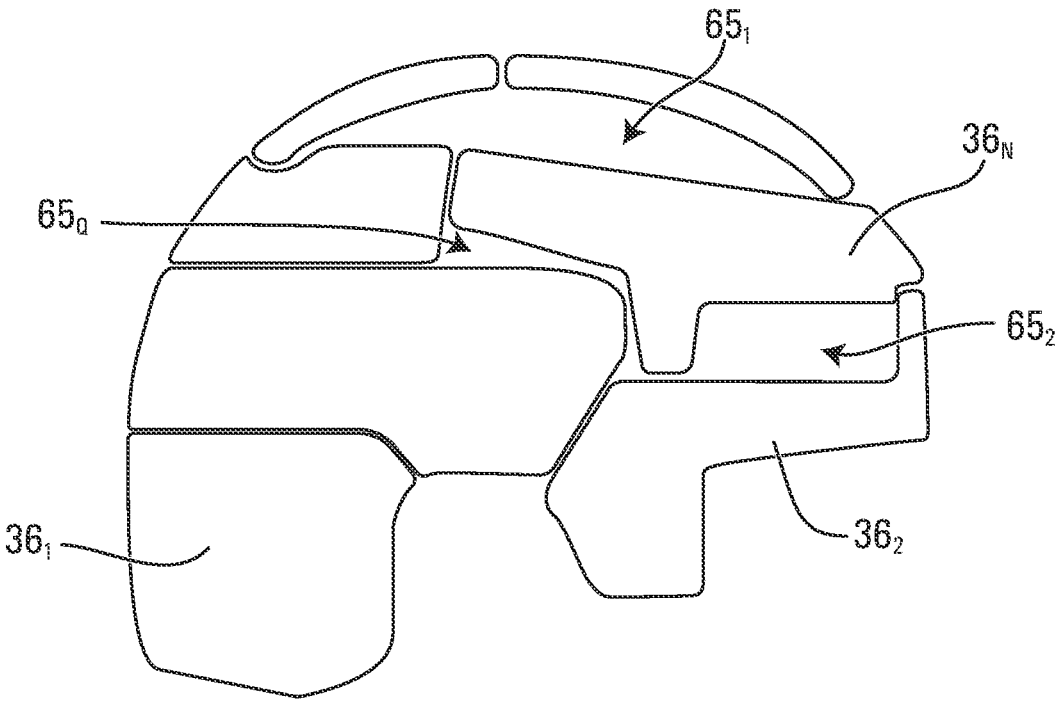
FIGS. 21A and 21B show an example of pads of the helmet of FIG. 19 in an open position and a closed position, respectively.
Figure 21B:
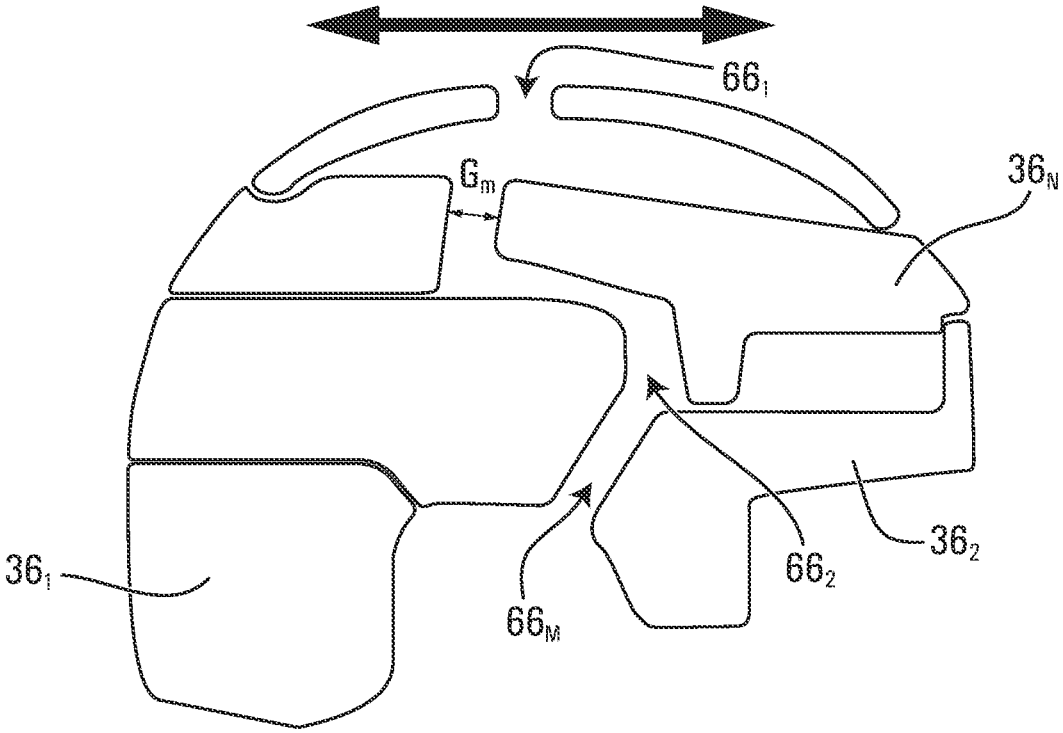
Figure 22:
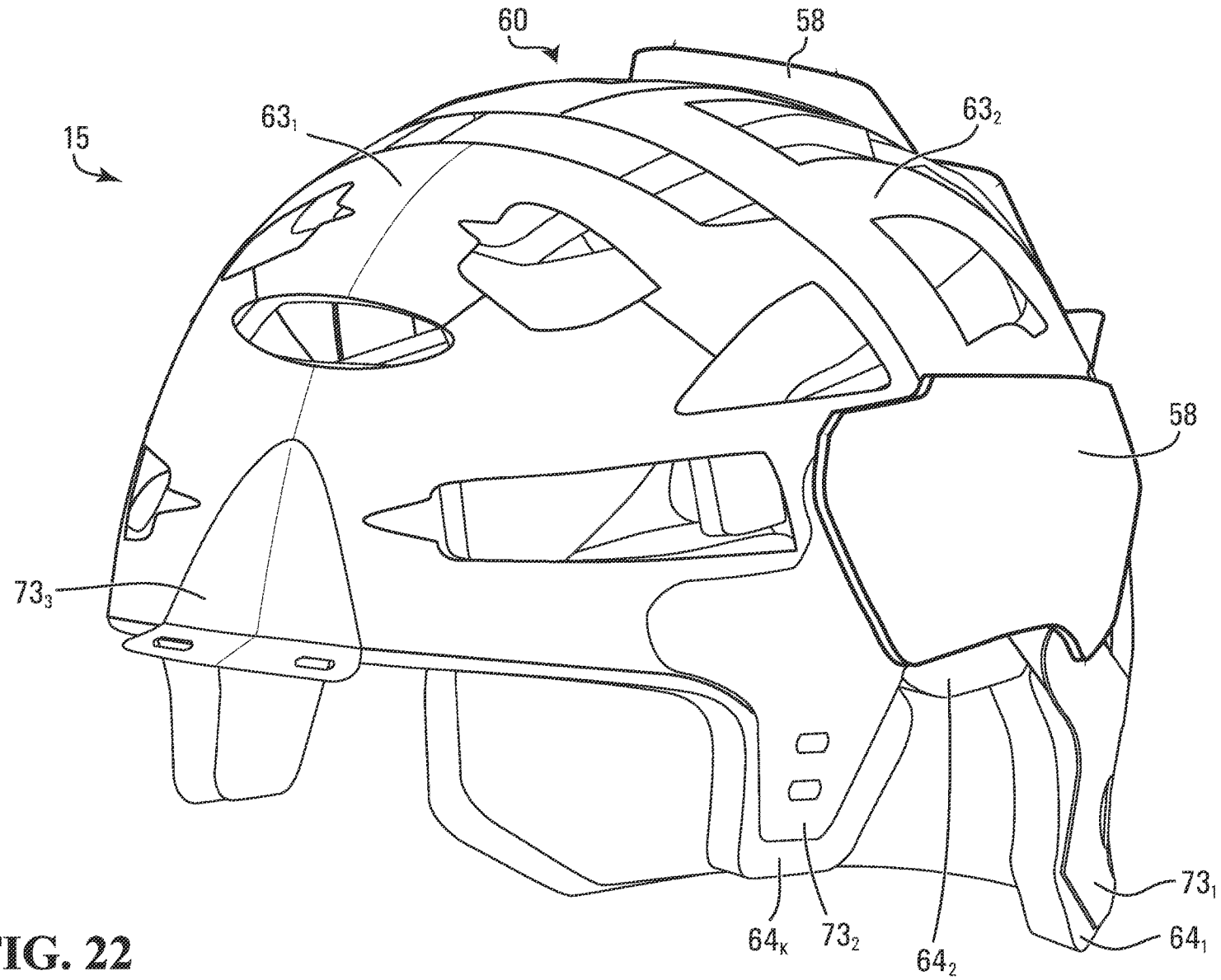
FIG. 22 shows the pads and the frame of the helmet of FIG. 19.

In this embodiment, although each of the pads $\mathbf{36}_1$-$\mathbf{36}_N$ is only attached to one of the front frame member $\mathbf{63}_1$ and the rear frame member $\mathbf{63}_2$, select ones of the pads $\mathbf{36}_1$-$\mathbf{36}_N$ attached to the front frame member $\mathbf{63}_1$ may overlap the rear frame member $\mathbf{63}_2$. Similarly, select ones of the pads $\mathbf{36}_1$-$\mathbf{36}_N$ attached to the rear frame member $\mathbf{63}_2$ may overlap the front frame member $\mathbf{63}_1$. Such an overlapping configuration allows for the maximum gap $G_m$ of the gaps $\mathbf{66}_1$-$\mathbf{66}_M$ to be a suitable distance in comparison to conventional adjustable helmets. With reference to FIGS. 21A and 21B, the pads $\mathbf{36}_1$-$\mathbf{36}_N$ may reduce the size of the maximal gap of the gaps $\mathbf{66}_1$-$\mathbf{66}_M$ between adjacent ones of the pads $\mathbf{36}_1$-$\mathbf{36}_N$ when the adjustment mechanism 40 is operated to set the maximal size of the helmet 10 in comparison to conventional adjustable helmets. In particular, FIG. 21A shows the helmet 10 is in the closed position, that corresponds to the minimum size of the helmet 10, and where there are existing gaps $\mathbf{65}_1$-$\mathbf{65}_Q$ between adjacent ones of the pads $\mathbf{36}_1$-$\mathbf{36}_N$ but which are typically less than the maximal gap. Moreover, FIG. 21 B shows the helmet 10 is in the open position, that corresponds to the maximum size of the helmet 10, and where there are gaps $\mathbf{66}_1$-$\mathbf{66}_M$ between adjacent ones of the pads $\mathbf{36}_1$-$\mathbf{36}_N$.

The combination of the frame 60, the absorption pads $\mathbf{36}_1$-$\mathbf{36}_N$ and the comfort pads $\mathbf{64}_1$-$\mathbf{64}_K$ may thus assist in ensuring that protection is provided against all types of impacts, including, high-energy, low-energy, linear and rotational impacts.

Figure 23:
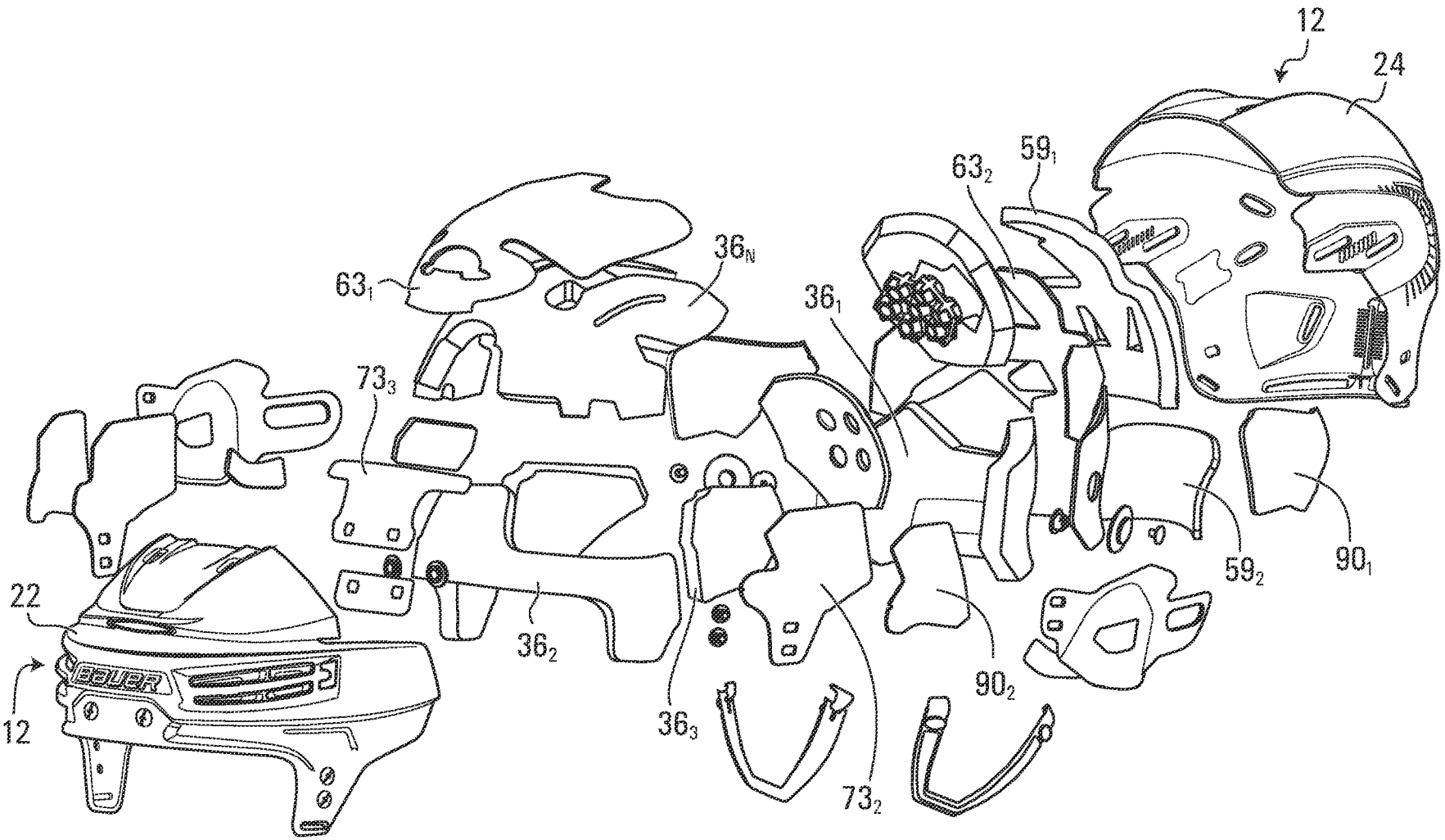
FIG. 23 shows a perspective exploded view of the helmet in accordance with another embodiment of the invention.
Figure 24:
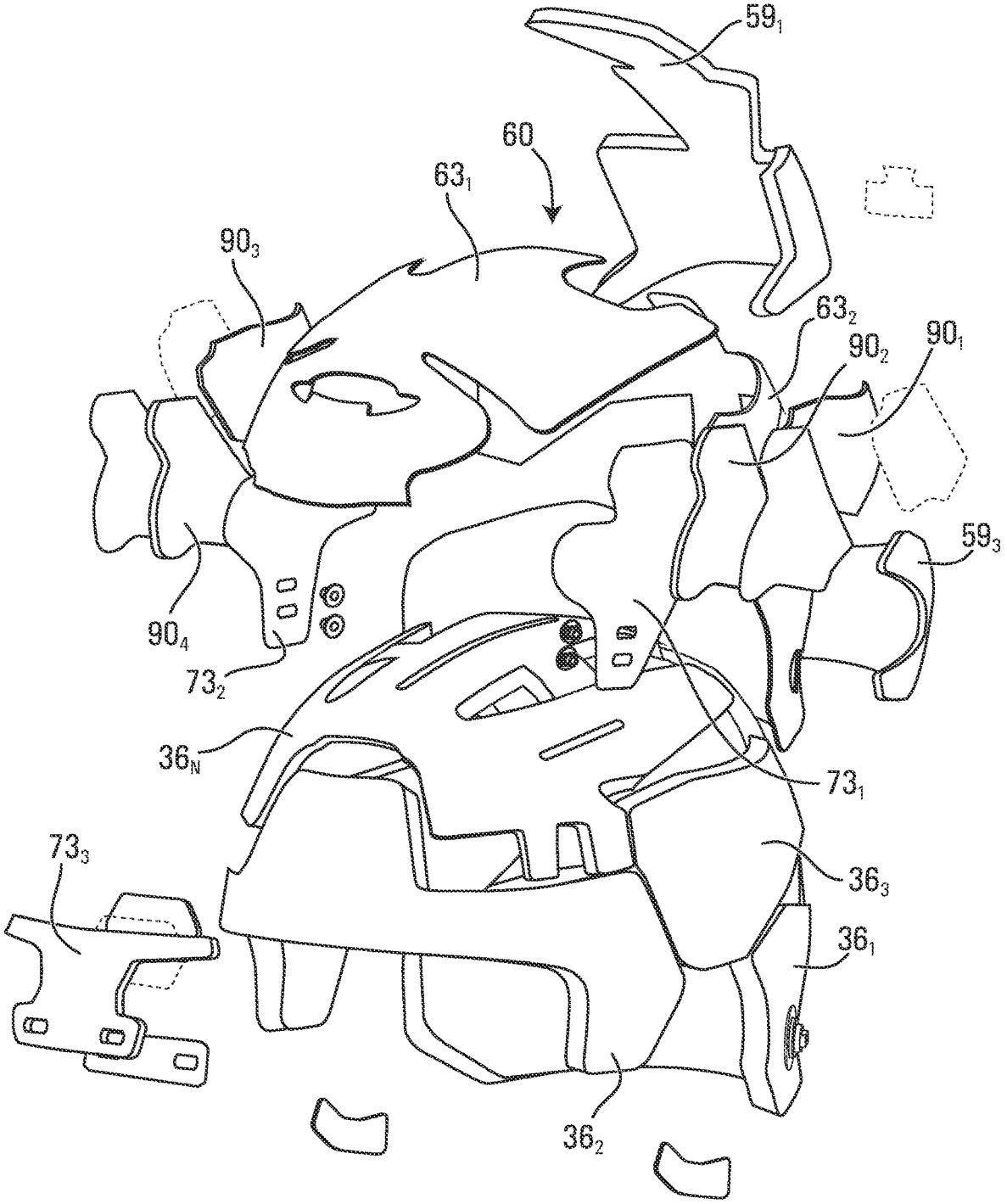
FIG. 24 shows a perspective exploded view of pads and a frame of the helmet of FIG. 23.
Figure 25:
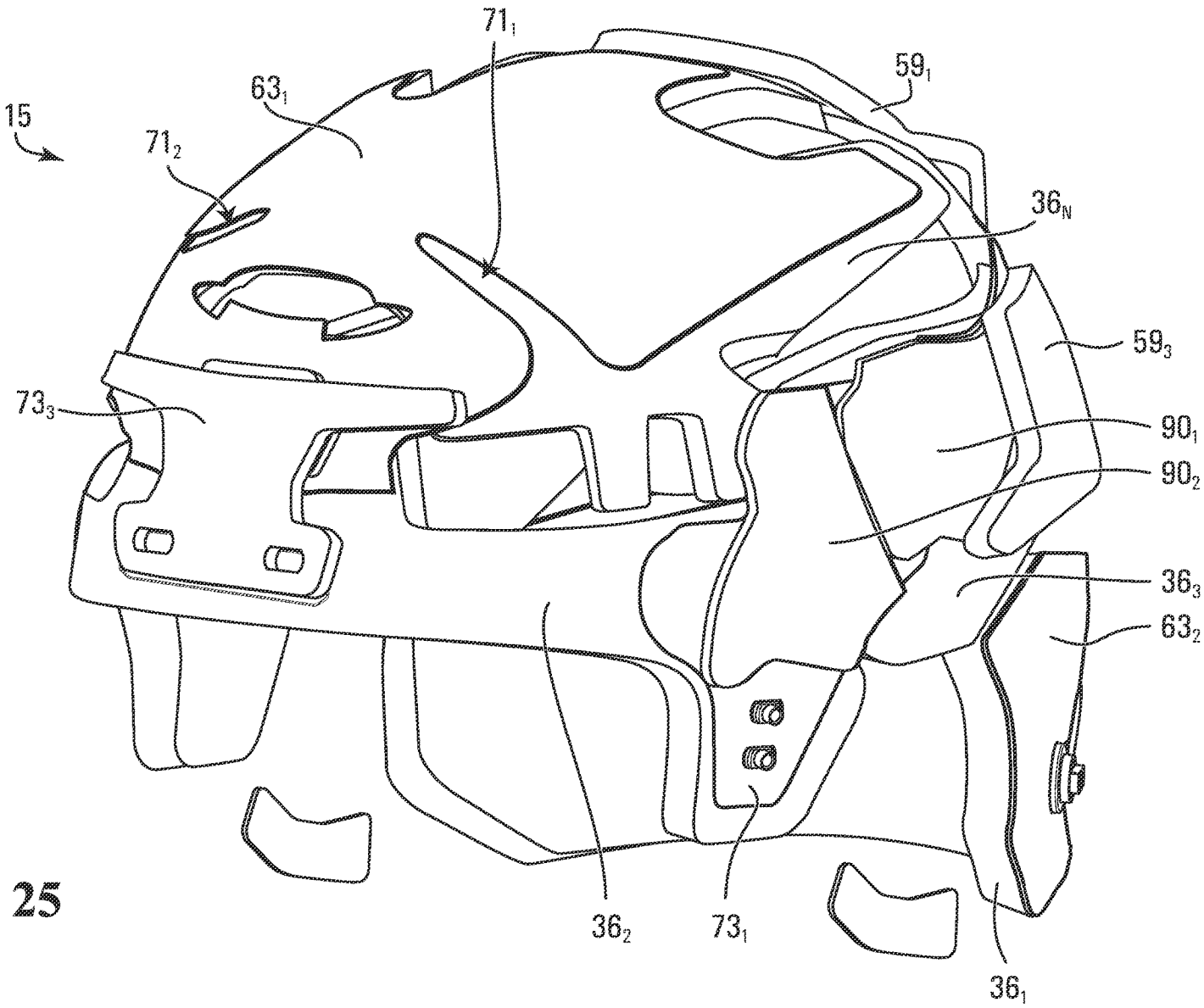
FIG. 25 shows a perspective view of the pads and the frame of the helmet of FIG. 23.

FIGS. 23 to 25 show another embodiment of the helmet 10 that comprises the absorption pads $\mathbf{36}_1$-$\mathbf{36}_N$, the frame 60 carrying the absorption pads $\mathbf{36}_1$-$\mathbf{36}_N$, and the comfort pads $\mathbf{64}_1$-$\mathbf{64}_K$ according to another variant. In this embodiment, given ones of the pads $\mathbf{36}_1$-$\mathbf{36}_N$ are configured to move relative to one another in response to an impact on the helmet, by virtue of movement of the front frame member $\mathbf{63}_1$ and the rear frame member $\mathbf{63}_2$. The front frame member $\mathbf{63}_1$ is connected to the outer shell 12 by respective ones of the connectors $\mathbf{73}_1$-$\mathbf{73}_p$. The rear frame member $\mathbf{63}_2$ is connected to the outer shell 12 by fastening hardware. In examples of implementation, the rear frame member $\mathbf{63}_2$ has holes for receiving the fastening hardware (e.g., screws, bolts, etc.). In this embodiment, the frame 63 is thin and is deformable in response to the impact and the connectors $\mathbf{73}_1$-$\mathbf{73}_p$ are thin but are not deformable or less deformable than the frame 63. As shown, the front frame member $\mathbf{63}_1$ includes openings $\mathbf{71}_1$-$\mathbf{71}_J$, (e.g. slots) which facilitate deformability of the front frame member $\mathbf{63}_1$. Also, the material 61 of the front frame member $\mathbf{63}_1$ facilitates deformability of the front frame member $\mathbf{63}_1$. In this embodiment, the inner padding 15 comprises a plurality of absorbing pads $\mathbf{90}_{1\text{-}C}$ that are fixed to the outside of the frame 63 and are not fixed directly to the outer shell 12. As the pads $\mathbf{90}_{1\text{-}C}$ are not fixed to outer shell 12, the pads $\mathbf{90}_{1\text{-}C}$ are moveable in respect to the outer shell 12 in response to the impact.

Any feature of any embodiment discussed herein may be combined with any feature of any other embodiment discussed herein in some examples of implementation.

Although in embodiments considered above the helmet 10 is a hockey helmet for protecting the head of a hockey player, in other embodiments, a helmet constructed using principles described herein in respect of the helmet 10 may be another type of sport helmet. For instance, a helmet constructed using principles described herein in respect of the helmet 10 may be for protecting the head of a player of another type of contact sport (sometimes referred to as "full-contact sport" or "collision sport") in which there are significant impact forces on the player due to player-to-player and/or player-to-object contact. For example, in one embodiment, a helmet constructed using principles described herein in respect of the helmet 10 may be a lacrosse helmet for protecting the head of a lacrosse player. As another example, in one embodiment, a helmet constructed using principles described herein in respect of the helmet 10 may be a football helmet for protecting the head of a football player. As another example, in one embodiment, a helmet constructed using principles described herein in respect of the helmet 10 may be a baseball helmet for protecting the head of a baseball player (e.g., a batter or catcher). Furthermore, a helmet constructed using principles described herein in respect of the helmet 10 may be for protecting the head of a wearer involved in a sport other than a contact sport (e.g., bicycling, skiing, snowboarding, horseback riding or another equestrian activity, etc.).

Also, while in the embodiments considered above the helmet 10 is a sport helmet, a helmet constructed using principles described herein in respect of the helmet 10 may be used in an activity other than sport in which protection against head injury is desired. For example, in one embodiment, a helmet constructed using principles described herein in respect of the helmet 10 may be a motorcycle helmet for protecting the head of a wearer riding a motorcycle. As another example, in one embodiment, a helmet constructed using principles described herein in respect of the helmet 10 may be a industrial or military helmet for protecting the head of a wearer in an industrial or military application.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A helmet for protecting a head of a wearer, the helmet comprising:

an outer shell; and inner padding disposed within the outer shell and comprising:

a network of structural members interconnected at nodes that is configured to resiliently deform from an original configuration in response to an impact on the helmet and return to the original configuration after the impact on the helmet; and a pad adjacent to the network of structural members.

2. The helmet of claim 1, wherein the structural members are elongated.

3. The helmet of claim 2, wherein given ones of the structural members are curved.

4. The helmet of claim 1, wherein at least three of the structural members intersect at each of multiple ones of the nodes.

5. The helmet of claim 1, wherein the pad is disposed between the outer shell and the network of structural members.

6. The helmet of claim 1, wherein the pad is configured to be disposed between the network of structural members and the wearer's head.

7. The helmet of claim 1, wherein: the pad is a first pad; and the inner padding comprises a second pad separate from the first pad and adjacent to the network of structural members.

8. The helmet of claim 7, wherein the first pad and the second pad are disposed between the outer shell and the network of structural members.

9. The helmet of claim 7, wherein the first pad and the second pad are configured to be disposed between the network of structural members and the wearer's head.

10. The helmet of claim 7, wherein: the first pad is disposed between the outer shell and the network of structural members; and the second pad is configured to be disposed between the network of structural members and the wearer's head.

11. The helmet of claim 7, wherein: the inner padding comprises a third pad and a fourth pad separate from one another, separate from the first pad and the second pad, and adjacent to the network of structural members.

12. The helmet of claim 11, wherein: the first pad and the second pad are disposed between the outer shell and the network of structural members; and the third pad and the fourth pad are configured to be disposed between the network of structural members and the wearer's head.

13. The helmet of claim 7, wherein the first pad and the second pad are mounted to respective ones of the nodes and configured to move relative to one another in response to the impact on the helmet.

14. The helmet of claim 7, wherein a material of the first pad is different from a material of the second pad.

15. The helmet of claim 1, wherein an elastic modulus of a material of the network of structural is no more than 10 GPa.

16. The helmet of claim 1, wherein an elastic modulus of a material of the network of structural is no more than 5 GPa.

17. The helmet of claim 1, wherein the network of structural members includes thermoplastic material.

18. The helmet of claim 1, wherein the network of structural members is fastened to the outer shell.

19. The helmet of claim 1, wherein the network of structural members is thinner than the pad.

20. The helmet of claim 1, comprising an adjustment mechanism configured to adjust a fit of the helmet on the wearer's head.

21. The helmet of claim 20, wherein individual ones of the structural members are configured to move relative to one another when the adjustment mechanism is operated to adjust the fit of the helmet on the wearer's head.

22. The helmet of claim 20, wherein the outer shell comprises a plurality of shell members configured to move relative one another when the adjustment mechanism is operated to adjust the fit of the helmet on the wearer's head.

23. The helmet of claim 20, wherein: the outer shell comprises a plurality of shell members; and the shell members are configured to move relative to one another and individual ones of the structural members are configured to move relative to one another when the adjustment mechanism is operated to adjust the fit of the helmet on the wearer's head.

24. The helmet of claim 1, wherein: the outer shell comprises a plurality of ventilation holes allowing air to circulate around the wearer's head: and the ventilation holes overlap with the network of structural members.

25. A helmet for protecting a head of a wearer, the helmet comprising:

an outer shell; and inner padding disposed within the outer shell and comprising:

a network of structural members interconnected at nodes that is configured to resiliently deform from an original configuration in response to an impact on the helmet and return to the original configuration after the impact on the helmet; and a pad disposed between the outer shell and the network of structural members.

26. A helmet for protecting a head of a wearer, the helmet comprising:

an outer shell comprising a plurality of shell members;

inner padding disposed within the outer shell, the inner padding comprising a network of structural members interconnected at nodes that is configured to resiliently deform from an original configuration in response to an impact on the helmet and return to the original configuration after the impact on the helmet; and an adjustment mechanism configured to move the shell members relative to one another and move portions of the inner padding relative to one another for adjusting a fit of the helmet on the wearer's head.

* * * * *